US005537188A

United States Patent [19]

Haneda

[11] Patent Number: 5,537,188

[45] Date of Patent: Jul. 16, 1996

[54] COLOR IMAGE FORMING APPARATUS HAVING A PROCESS CARTRIDGE AND A COLOR DEVELOPER CARTRIDGE

[75] Inventor: Satoshi Haneda, Hachioji, Japan

[73] Assignee: Konica Corporation, Tokyo, Japan

[21] Appl. No.: 280,776

[22] Filed: Jul. 26, 1994

[30] Foreign Application Priority Data

Aug. 20, 1993 [JP] Japan ..... 5-206604
Aug. 23, 1993 [JP] Japan ..... 5-207975

[51] Int. Cl.[6] ..... G03G 15/01

[52] U.S. Cl. ..... 355/210; 355/200; 355/326 R; 355/327

[58] Field of Search ..... 355/326 R, 327, 355/200, 210; 346/157; 347/115, 232

[56] References Cited

U.S. PATENT DOCUMENTS

| | | | |
|---|---|---|---|
| 4,878,091 | 10/1989 | Morita et al. | 355/326 R X |
| 4,928,144 | 5/1990 | Kasahara et al. | 355/326 R X |
| 5,036,367 | 7/1991 | Haneda et al. | 355/326 R |
| 5,083,158 | 1/1992 | Kashima et al. | 355/200 |
| 5,107,304 | 4/1992 | Haneda et al. | 355/327 X |
| 5,119,134 | 6/1992 | Haneda et al. | 355/326 R |
| 5,287,161 | 2/1994 | Matsuo et al. | 355/326 R |
| 5,327,208 | 7/1994 | Matsuo et al. | 355/326 R |

FOREIGN PATENT DOCUMENTS

| | | |
|---|---|---|
| 0276910 | 8/1988 | European Pat. Off. . |
| 0397465 | 11/1990 | European Pat. Off. . |
| 2190757 | 11/1987 | United Kingdom . |

OTHER PUBLICATIONS

Patent Abstracts of Japan, vol. 017, No. 372 (P–1573) Jul. 13, 1993 & JP–A–05 061 313 (Konica Corp.) Mar. 12, 1993.

*Primary Examiner*—Matthew S. Smith
*Attorney, Agent, or Firm*—Frishauf, Holtz, Goodman, Langer & Chick

[57] ABSTRACT

An image forming apparatus, such as a copier or a printer reproduces an image on a recording sheet. The apparatus includes: a photoreceptor drum; a latent image writer for forming a latent image of the image on the surface of the photoreceptor drum; black, yellow, magenta, and cyan developers each for developing the latent image with a respective color toner so as to form a respective color developed latent image on the surface; a transferor for transferring the color developed latent images from the surface of the photoreceptor to the recording sheet; a cleaner for cleaning a residual toner on the surface after a transferring operation of the transferor; a color developer cartridge for unitedly supporting the yellow, magenta, and cyan developers; a process cartridge for unitedly supporting the photoreceptor drum, the black developer, and the cleaner; and a coupler for coupling the color developer cartridge and the process cartridge to the apparatus. The color developer cartridge and the process cartridge are detachable from the apparatus and the process cartridge is prevented from being detached from the apparatus until the color developer cartridge is detached from the apparatus.

11 Claims, 29 Drawing Sheets

COLOR IMAGE FORMING APPARATUS HAVING A PROCESS CARTRIDGE AND A COLOR DEVELOPER CARTRIDGE

BACKGROUND OF THE INVENTION

The present invention relates to a color image forming apparatus using a photoreceptor drum or a photoreceptor belt on the surface of which a toner image is formed, and specifically to a color image forming apparatus by which a color image can be recorded other than a black toner image when color developing units are optionally equipped to the apparatus.

Conventionally, the following is known: a plurality of developing units are provided around the photoreceptor drum or photoreceptor belt in an image recording apparatus having the photoreceptor drum or photoreceptor belt. Specifically, an apparatus in which the photoreceptor belt is used is suitable for color image recording, for which many developing units are necessary. Because the developing units can be provided in almost the same condition. In this case, a black toner image and a color image can be recorded when 4 developing units are provided in which yellow, magenta, cyan and black toners are respectively loaded. In the conventional color image forming apparatus described above, in order to easily replace 4 developing units or in order to easily supply toners to the developing units, 4 developing units can be attached to and detached from the apparatus together with the photoreceptor drum or photoreceptor belt, or 4 developing units can be integrally attached to and detached from the apparatus independently from the photoreceptor drum or photoreceptor belt. However, when only a black toner image is recorded, developing units other than that for black toner are surplus. In order to replenish the frequently used black toner, other developing units should be detached from and attached to the apparatus together with the developing unit for black toner, which is ineffectual and can cause problems.

SUMMARY OF THE INVENTION

The present invention is made in order to solve the foregoing problems. The object of the present invention is to provide an image forming apparatus having a photoreceptor drum or a photoreceptor belt which is structured as follows: developing units for developers Y, M, C for a color image can be optionally added to the apparatus; the developing units for a color image in the case of color image recording can be easily attached to the apparatus when a replaceable cartridge composed of Y, M, C developing units is attached to the apparatus; and when toners are replenished in each developing unit, a replaceable process cartridge or cartridge composed of developing units are taken out of the apparatus, and the toners can be independently replenished to the developing unit for a monochrome image and the developing units for a color image.

That is, the object of the present invention is to provide a color image forming apparatus, by which a high quality image can be obtained and which can be easily operated. The invention is structured as follows: developing units of the color image forming apparatus can be separated into the developing unit for a monochrome image and the developing units for a color image; the image forming apparatus can be used for a monochrome image forming apparatus under the condition that developing units are separated; the image forming apparatus can be operated as a color image forming apparatus under the condition that the developing units are combined; and the toner supply and the renewal of the developing units are easily, positively, and efficiently conducted corresponding to frequency in which the developing units are operated for a monochrome image or a color image.

This object can be accomplished by any of the following technical means (1) to (32):

(1) An image forming apparatus having an image forming body, developing units of Y, M, C, and black, each being provided around the image forming body, and a cleaning section, the image forming apparatus characterized in that: the image forming apparatus is structured with a detachable and attachable process cartridge including the image forming body, a black developing unit and the cleaning section, and a detachable and attachable color developer cartridge composed of Y, M, and C developing units; the direction of detachment and attachment is parallel with a rotational axis of the image forming body in the case of the process cartridge, and is perpendicular to the rotational axis in the case of the color developer cartridge; the process cartridge is positioned so that the color developer cartridge interferes with the detachment and attachment of the process cartridge; in the case of detachment, the color developer cartridge is moved with priority; and the detachment and attachment direction of the process cartridge is perpendicular to that of the color developer cartridge.

(2) The color image forming apparatus described in item (1), which is characterized in that the color developer cartridge is detached and attached from the upper position of the color image forming apparatus.

(3) The color image forming apparatus described in item (1), which is characterized in that: a shielding member for shielding and unshielding an opening, at which the image forming body is opposed to the color developer cartridge, is provided in the process cartridge.

(4) The color image forming apparatus described in item (1), which is characterized in that the process cartridge and the color developer cartridge are respectively fixed to the image forming apparatus in the case of attachment.

(5) An image forming apparatus having an image forming body, developing units of Y, M, C, and black, each being provided around the image forming body, and a cleaning section, the image forming apparatus characterized in that: the image forming apparatus is structured with a detachable and attachable process cartridge including the image forming body, a black developing unit and the cleaning section, and detachable and attachable unit composed of Y, M, and C developing units; the direction of the detachment and attachment is perpendicular to rotational axis of the image forming body in both the process cartridge and the color developer cartridge; the process cartridge is positioned so that the color developer cartridge interferes with the detachment and attachment of the process cartridge; in the case of detachment, the color developer cartridge is moved with priority; and the process cartridge and unit are attached and detached respectively in the same direction.

(6) The color image forming apparatus described in item (5), which is characterized in that the cartridge and the color developer cartridge are detached and attached from the upper position of the color image forming apparatus.

(7) The color image forming apparatus described in item (5), which is characterized in that: the process cartridge and unit are attached and detached from the side of the developing units of the color image forming apparatus.

(8) The color image forming apparatus described in item (5), which is characterized in that: a shielding member for shielding and unshielding an opening at which the image forming body in the process cartridge is opposed to the color developer cartridge, is provided in the process cartridge.

(9) The color image forming apparatus described in item (5), which is characterized in that the process cartridge and the color developer cartridge are respectively fixed to the image forming apparatus.

(10) An image forming apparatus having an image forming body, developing units of Y, M, C, and black, each being provided around the image forming body, and a cleaning section, the image forming apparatus characterized in that: the image forming apparatus is structured by a detachable and attachable process cartridge including the image forming body, a black developing unit and the cleaning section, and detachable and attachable unit composed of Y, M, and C developing units; the direction of the detachment and attachment is perpendicular to rotational axis of the image forming body in both the process cartridge and the color developer cartridge; the process cartridge is positioned so that the color developer cartridge interferes with the detachment and attachment of the process cartridge; in the case of detachment, the color developer cartridge is moved with priority; and the process cartridge and unit are attached and detached respectively in the direction in which these approach each other and are separated from each other on both sides of the rotational axis.

(11) The color image forming apparatus described in item (10), which is characterized in that: the process cartridge and unit are attached and detached from the side of the color image forming apparatus.

(12) The color image forming apparatus described in item (10), which is characterized in that: a shielding member for shielding and unshielding an opening at which the image forming body in the process cartridge is opposed to the color developer cartridge, is provided in the process cartridge.

(13) The color image forming apparatus described in item (10), which is characterized in that the process cartridge and the color developer cartridge are respectively fixed to the image forming apparatus.

(14) An image forming apparatus having an image forming body, developing units of Y, M, C, and black, each being provided around the image forming body, and a cleaning section, the image forming apparatus characterized in that: the image forming apparatus is structured by a detachable and attachable process cartridge including the image forming body, a black developing unit and the cleaning section, and detachable and attachable unit composed of Y, M, and C developing units; the direction of the detachment and attachment is perpendicular to an rotational axis of the image forming body in the process cartridge and is on the side of the color developer cartridge, and is parallel with the rotational axis in the color developer cartridge; the process cartridge is positioned so that the color developer cartridge interferes with the detachment and attachment of the process cartridge; in the case of detachment, the color developer cartridge is moved with priority; and the detachment and attachment direction of the process cartridge is perpendicular to that of the color developer cartridge.

(15) The color image forming apparatus described in item (14), which is characterized in that: the process cartridge and unit are attached and detached from the side of the color image forming apparatus.

(16) The color image forming apparatus described in item (14), which is characterized in that: a shielding member for shielding and unshielding an opening at which the image forming body in the process cartridge is opposed to the color developer cartridge is provided in the process cartridge.

(17) The color image forming apparatus described in item (14), which is characterized in that the process cartridge and the color developer cartridge are respectively fixed to the image forming apparatus in the case of attachment.

(18) An image forming apparatus having an image forming body, developing units of Y, M, C, and black, each being provided around the image forming body, and a cleaning section, the image forming apparatus characterized in that: the image forming apparatus is structured by a detachable and attachable process cartridge including the image forming body, a black developing unit and the cleaning section, and detachable and attachable unit composed of Y, M, and C developing units; the direction of the detachment and attachment is perpendicular to an rotational axis of the image forming body in the process cartridge and on the side opposite the color developer cartridge, and is parallel with the rotational axis in the color developer cartridge; the process cartridge is positioned so that the color developer cartridge interferes with the detachment and attachment of the process cartridge; in the case of detachment, the color developer cartridge is moved with priority; and the detachment and attachment direction of the process cartridge is perpendicular to that of the color developer cartridge.

(19) The color image forming apparatus described in item (18), which is characterized in that: the process cartridge and unit are attached and detached from the side of the color image forming apparatus.

(20) The color image forming apparatus described in item (18), which is characterized in that: a shielding member for shielding and unshielding an opening at which the image forming body in the process cartridge is opposed to the color developer cartridge is provided in the process cartridge.

(21) The color image forming apparatus described in item (18), which is characterized in that the process cartridge and the color developer cartridge are respectively fixed to the image forming apparatus in the case of attachment.

(22) An image forming apparatus having an image forming body, developing units of Y, M, C, and black, each being provided around the image forming body, and a cleaning section, the image forming apparatus characterized in that: the image forming apparatus is structured by a detachable and attachable process cartridge including the image forming body, a black developing unit and the cleaning section, and detachable and attachable unit composed of Y, M, and C developing units; the direction of the detachment and attachment is parallel with a rotational axis of the image forming body in both the process cartridge and the color developer cartridge; the process cartridge is positioned so that the color developer cartridge interferes with the detachment and attachment of the process cartridge; in the case of detachment, the color developer cartridge is moved with priority; and the process cartridge and unit are attached and detached respectively in the same direction.

(23) The color image forming apparatus described in item (22), which is characterized in that the cartridge is detached and attached after the color developer cartridge has been withdrawn in the perpendicular direction to the rotational axis of the image forming body in the process cartridge.

(24) The color image forming apparatus described in item (22), which is characterized in that: a shielding member for shielding and unshielding an opening at which the image forming body in the process cartridge is opposed to the color developer cartridge is provided in the process cartridge.

(25) The color image forming apparatus described in item (22), which is characterized in that the process cartridge and the color developer cartridge are respectively fixed to the color image forming apparatus in the case of attachment.

(26) A color image forming apparatus having Y, M, C and black developing units which are adjacent to the image forming body in parallel, which is characterized in that: a process cartridge is structured when the image forming body is integrated with the black developing unit in which a toner hopper for loading therein a black toner is housed; another cartridge is structured when Y, M and C developing units are integrated with each other; the process cartridge and the color developer cartridge are detachably provided in the apparatus; and the black toner is replenished to the toner hopper after the color developer cartridge has been separated from the image forming body in the process cartridge.

(27) The color image forming apparatus described in item (26), which is characterized in that the separation is conducted in the manner that the cartridge moves with respect to the color developer cartridge.

(28) The image forming apparatus described in item (26), which is characterized in that the separation is conducted in the manner that the color developer cartridge moves with respect to the process cartridge.

(29) A color image forming apparatus having Y, M, C and black developing units which are adjacent to the image forming body in parallel, which is characterized in that: Y, M and C developing units are integrally provided with each other as a detachable and attachable unit; a toner hopper for replenishing the toner is provided to the black developing unit; and the toner hopper is provided adjacent to the cleaning section.

(30) The color image forming apparatus described in item (29), which is characterized in that the detachment and attachment direction of the color developer cartridge is the same as the drawing out direction of the toner hopper for replenishing black toner.

(31) A color image forming apparatus having Y, M, C and black developing units being adjacent to the image forming body in parallel, which is characterized in that: a black toner hopper for the black developing unit is provided adjacent to the cleaning section; Y, M and C toner hoppers are provided in upper portions of the Y, M and C developing units, and these toner hopers and developing units are integrated with each other so that a unit is formed; and the color developer cartridge is provided so that the color developer cartridge can be separated from the black developing unit.

(32) The color image forming apparatus described in item (31), characterized in that the black toner hopper, the image forming body and the black developing unit are integrated with each other and formed into a process cartridge.

That is, in the image forming apparatus of the present invention, a process cartridge in which a black developing unit is provided close to an image forming body, and a unit in which three developing units of Y, M and C for a color image are housed, are respectively attached to the image forming apparatus in a replaceable manner. Accordingly, when only a black toner image is recorded, only a process cartridge may be attached, and the color developer cartridge for color developing units need not be attached to the apparatus. Black toner can be replenished when only the process cartridge is detached from and attached to the apparatus as in the following cases where: the process cartridge is replaced; the developing unit in the process cartridge is replaced; or toner is supplied to the developing unit in the process cartridge. When a color image is recorded, toners for the color image can be replenished when the color developer cartridge composed of three developing units of Y, M and C for color image is detached from and attached to the apparatus as in the following cases where: the color developer cartridge for the color image is replaced; or toners are supplied to the developing units in the color developer cartridge.

In the structure of the main body, the process cartridge and the color developer cartridge can be positively attached to the apparatus when the developing units are attached to and detached from the apparatus after the process cartridge, which is larger than the color developer cartridge, has been coupled with a driving system and fixed to the main body. Further, the apparatus can be structured in a manner that the developing units contact a portion of the process cartridge and accordingly, a gap between the photoreceptor and the developing sleeve in the developing unit can be positively maintained.

The color image forming apparatus can always be structured with the color developer cartridge and the process cartridge equipped with the black toner hopper and the black developing unit. When Y, M and C developing units for color are used the same number of times as the black developing unit and the life is used up, the developing units are detached from the process cartridge and can be replaced with new developing units, maintenance can be easily performed, and each color toner can be easily supplied at the time of operation of the apparatus.

It is convenient when the image forming apparatus of this combination is almost used for color image formation. However, when the image forming apparatus is used only for a monochrome image, the image forming apparatus of this combination is not always better because Y, M and C developing units for a color image are always attached to the apparatus.

DETAILED DESCRIPTION OF THE INVENTION

Figure 1:
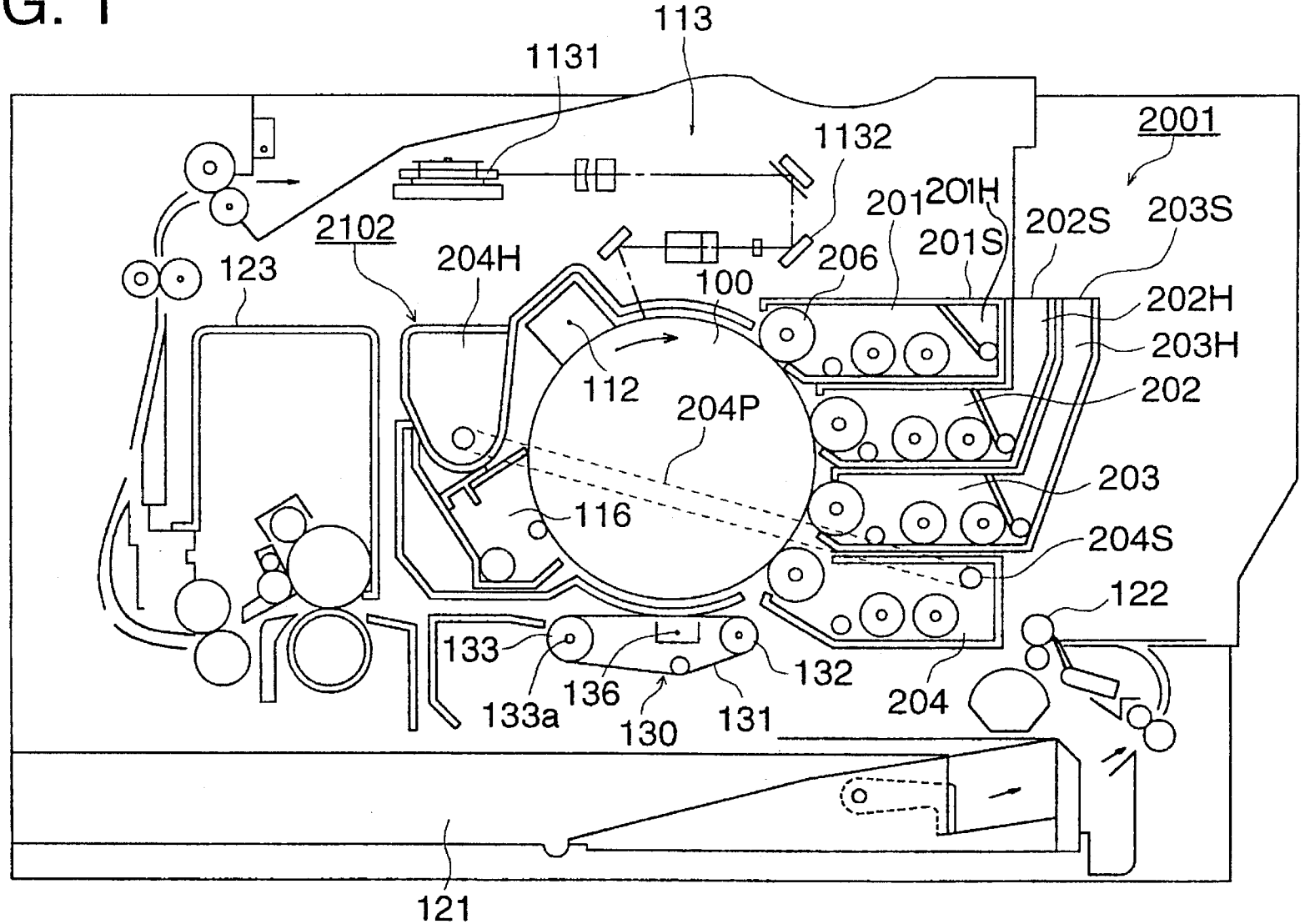
FIG. 1 is a side view of an example of the present invention.

Referring to the drawings, examples of the present invention will be described below.

Figure 32:
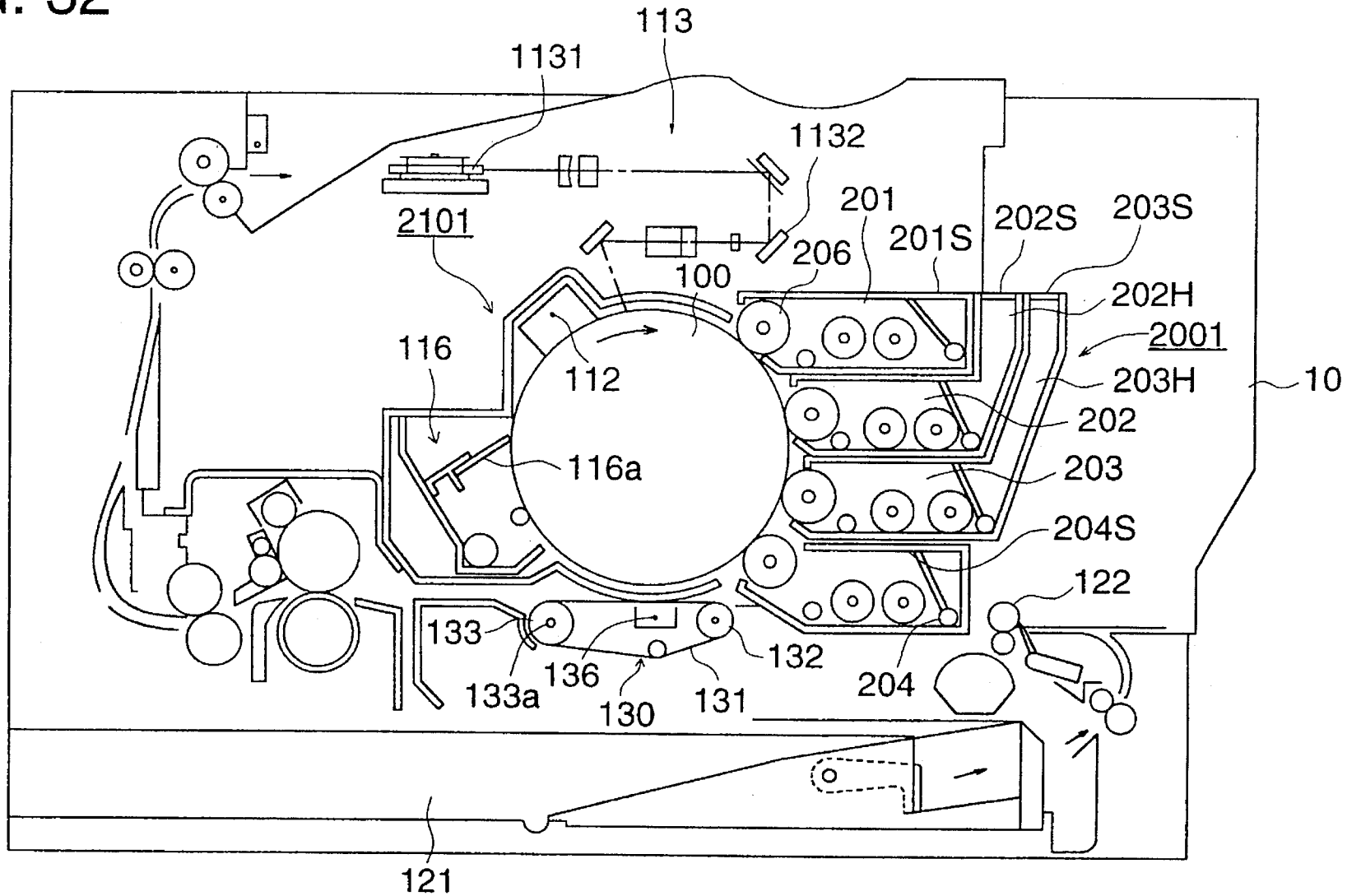
FIG. 32 is a side view of an example of the present invention.

FIG. 1 and FIG. 32 show examples of a color image forming apparatus of the present invention.

In these drawings, numeral 100 is a photoreceptor drum which is an image forming body, and an OPC photoreceptor is coated on the drum. The image forming body is grounded and rotated clockwise. Numeral 112 is a charger and located on the peripheral surface of the photoreceptor drum 100. Prior to the charge by the charger 112, the peripheral surface of the photoreceptor is exposed by a PCL (Pre-Charging Lamp) using a light emitting diode or the like, and is discharged in order to erase the hysteresis of the photoreceptor.

After the photoreceptor has been uniformly charged, image exposure is conducted by an image exposure means 113 according to an image signal. The following operations are conducted by the image exposure means 113 in which a laser diode, not shown in the drawings, is used as a light emitting source: an optical path is bent by a reflection mirror 1132 through a polygonal mirror 1131 which is rotated, an fθ lens and the like; a scanning operation is conducted on the photoreceptor drum 100; and a latent image is formed when the photoreceptor drum 100 is rotated (the secondary scanning). In this example, an image section is exposed and a reversal latent image is formed.

Developing units 201, 202, 203 and 204, in which developers made of toners consisting of yellow (Y), magenta (M), cyan (C) and black (K), and the carrier are respectively loaded, are provided around the photoreceptor drum 100. Initially, the first color development is conducted by a developing sleeve 206 in which a magnet is housed and which is rotated while the developer is being maintained. The developer is made of: a carrier in which ferrite is used as a core, and insulating resin is coated around the core; and toner in which polyester is used as a main material, and pigment corresponding to colors, a charging control agent, silica and titanium oxide are added to polyester. The thickness of the developer layer on the developing sleeve 206 is regulated by a bristle height regulation plate, and the developer is conveyed to a developing area.

A gap between the developing sleeve 206 and the photoreceptor drum 100 in the developing area is a gap $D_{SD}$ which is larger than the layer thickness (developer), and a bias voltage is impressed upon the gap. The polarity of this bias voltage is the same as that of a charge of toner, and accordingly, image visualization (reversal development) is carried out by toner which seizes an opportunity to be separated from carrier by the bias voltage.

After the first visualization has been completed, the second color image forming process starts. Uniform charging by a scorotron charger 112 is conducted again, and a latent image by the second color image data is formed by an image exposure means 113. At this time, discharging by the PLC conducted in the first color image forming process is not conducted because toner adhered to the first color image section scatters when the surrounding voltage suddenly drops.

In the photoreceptor which had a high voltage again over all the peripheral surface of the photoreceptor drum 100, the same latent image as the first color latent image is formed on a portion on which the first color image does not exist, and developed. However, on a portion on which development is conducted again with respect to a portion on which the first color image exists, a latent image is formed by light shielding of the adhered first color toner and charge of the toner itself, and development is conducted corresponding to the bias potential difference.

The third color and the fourth color image forming processes are conducted in the same manner as the second color image forming process, and the four color visual image is formed on the peripheral surface of the photoreceptor drum 100.

On the other hand, a recording sheet P, which has been fed by a sheet feeding mechanism from a sheet feed cassette 121, conveyed onto a transfer area by a transfer belt unit 130 in which a transfer belt 131 is stretched, and a multi-color image on the peripheral surface of the photoreceptor drum 100 is collectively transferred onto the recording sheet P.

The transfer belt 131 is a rubber belt in which an FLC (Florine Latex Coat) layer is formed outside a base body of urethane rubber, and the belt is formed into an endless-shaped belt having the resistance of $10^6$ to $10^{14}$ Ω.cm and a thickness of 0.4 to 1.0 mm. This transfer belt 131 is stretched between holding rollers 132 and 133. The recording sheet P enters into a nip portion (a transfer area) formed by the photoreceptor drum 100 and the transfer belt 131. The transfer electric field is given onto the rear surface of the transfer belt 131 by a corona discharger 136 and a multi-color image is transferred onto the recording sheet P.

The recording sheet P separated from the photoreceptor drum 100 is discharged by an AC corona discharge using the shaft of the holding roller 133, positioned downstream side of two rollers between which the transfer belt 131 is stretched, as an opposing electrode. After or during the AC corona discharge, the recording sheet P is separated from the transfer belt 131. The transfer belt 131 in the transfer belt unit 130 is separated from the photoreceptor drum 100 during the multi-color image formation, and is rotated around the shaft **133*a* of the downstream side holding roller 133**.

The recording sheet P which has been separated from the transfer belt unit 130 and on which the multi-color image is held, is conveyed to a fixing unit 123 structured by two pressure rollers in which a heater is provided in at least one of two rollers. The adhered toner is fused when heat and pressure are applied onto the recording sheet P between two pressure rollers and delivered outside the apparatus after the toner has been fixed onto the recording sheet P.

The residual toner remaining on the photoreceptor drum 100 after transfer is discharged by the discharger using an AC corona discharger, and after that, the residual toner moves to a cleaning section 116. Then, the residual toner is scraped down into the cleaning section 116 by a rubber cleaning blade **116*a* which is contacted with the photoreceptor, and delivered outside by a screw or stored in the cleaning section 116**.

The photoreceptor drum 100 from which the residual toner is removed by the cleaning section 116 is uniformly charged by a scorotron charger 112 after being exposed by a PCL, and enters into the next image forming cycle. During a multi-color image formation, the cleaning blade **116*a*** is separated from the photoreceptor surface, and an AC discharge by the discharger is maintained in an OFF condition.

Figure 30:
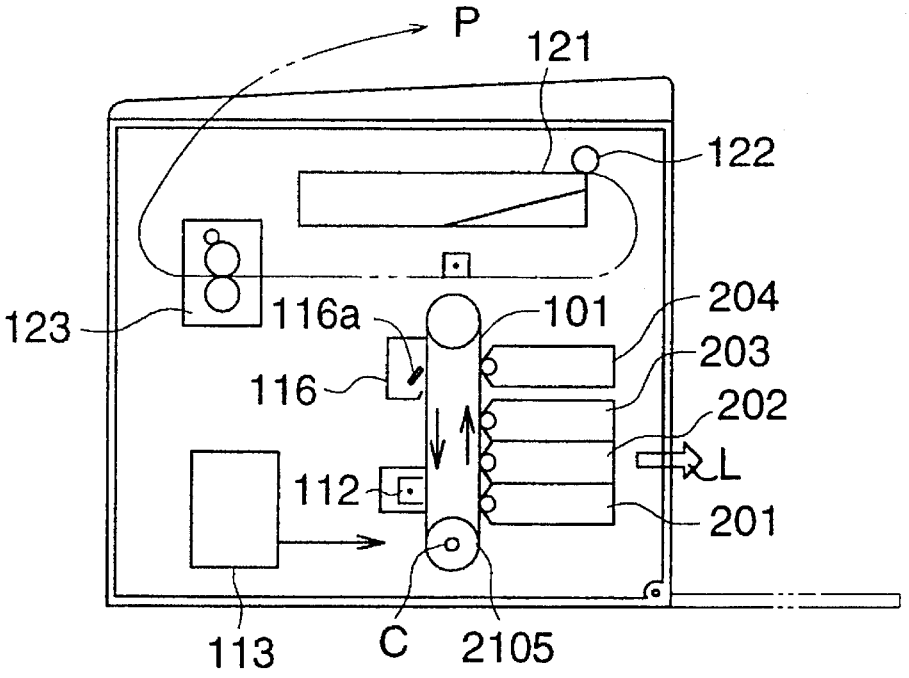
FIG. 30 is a side view of the color image forming apparatus in which the process cartridge using a belt type photoreceptor and the color developer cartridge are incorporated.
Figure 31:
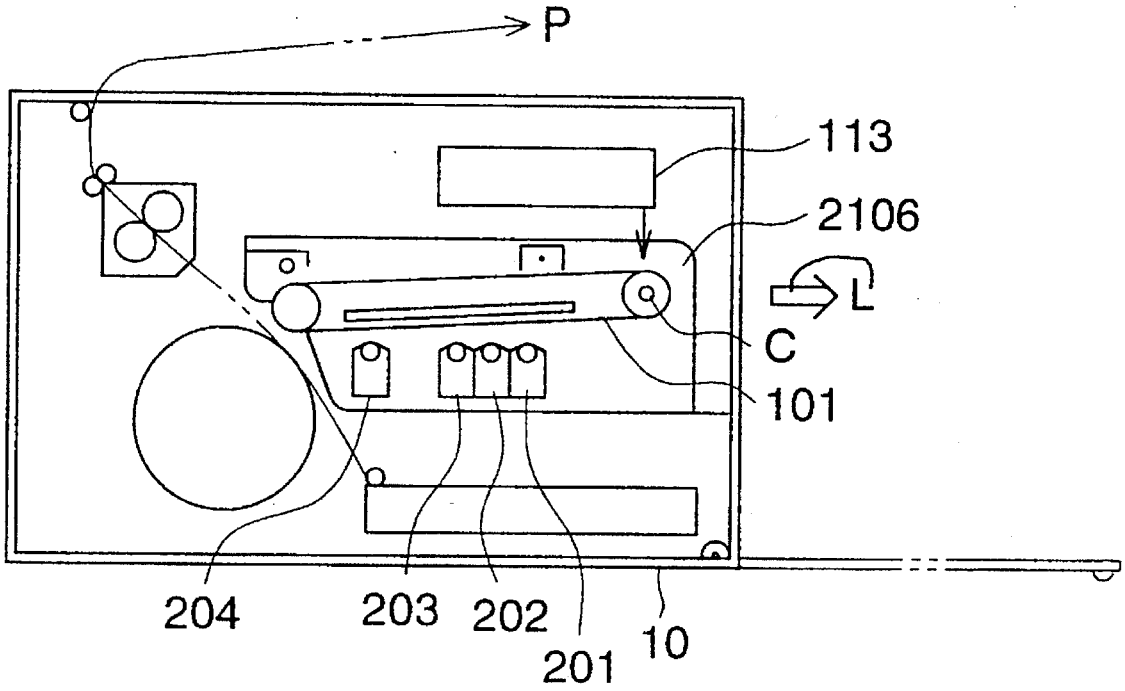
FIG. 31 is a side view of the color image forming apparatus in which the process cartridge using a belt type photoreceptor and the color developer cartridge are incorporated.

Although the foregoing explanation is done according to the case where the image forming body is the photoreceptor drum 100, excellent image formation can be carried out by approximately the same process in the case where a photoreceptor belt 101 as shown in side views of FIGS. 30 and 31 is used as the image forming body.

Referring to the drawings, examples will be described in detail below according to items corresponding to claims of the present invention.

In a color image forming apparatus having general functions for color image formation described above, the first example of the present invention is structured as follows: as shown in perspective views in FIGS. 5 and 6, the photoreceptor drum 100 (having a rotation axis 100A), the cleaning section 116, the charger 112 and the black developing unit 204, to which the black toner hopper 204H is connected with a screw pipe 204P, are integrated with each other and formed into a process cartridge 2102; as shown in perspective views in FIGS. 5 and 6, color developing units of Y, M and C are incorporated into color developer cartridge 2001, 2003 or 2004; and these process cartridge and color developer cartridge can be separated from each other.

Figure 2:
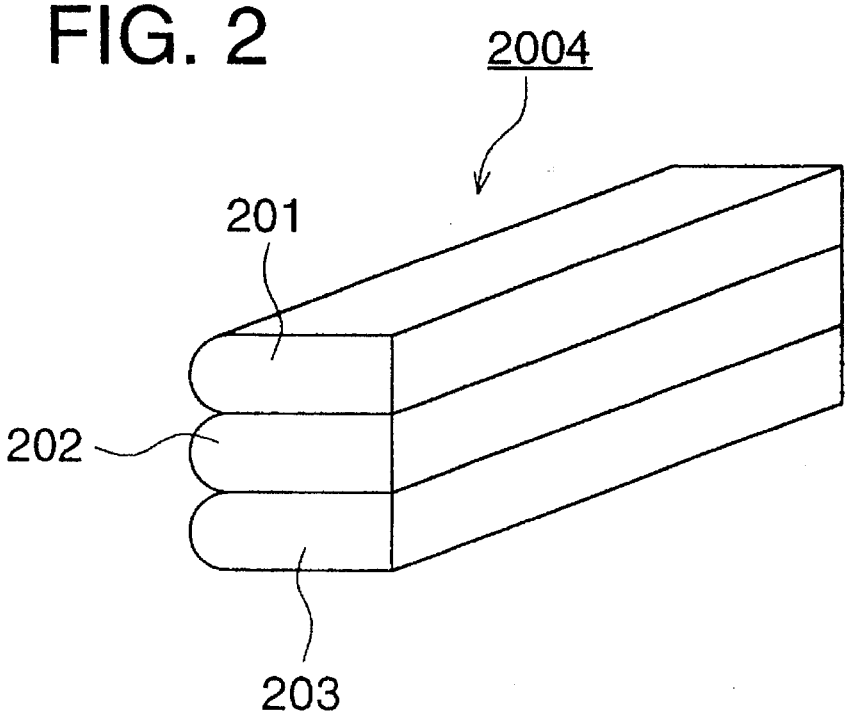
FIG. 2 is a perspective view of an example of a color developer cartridge of the present invention.
Figure 3:
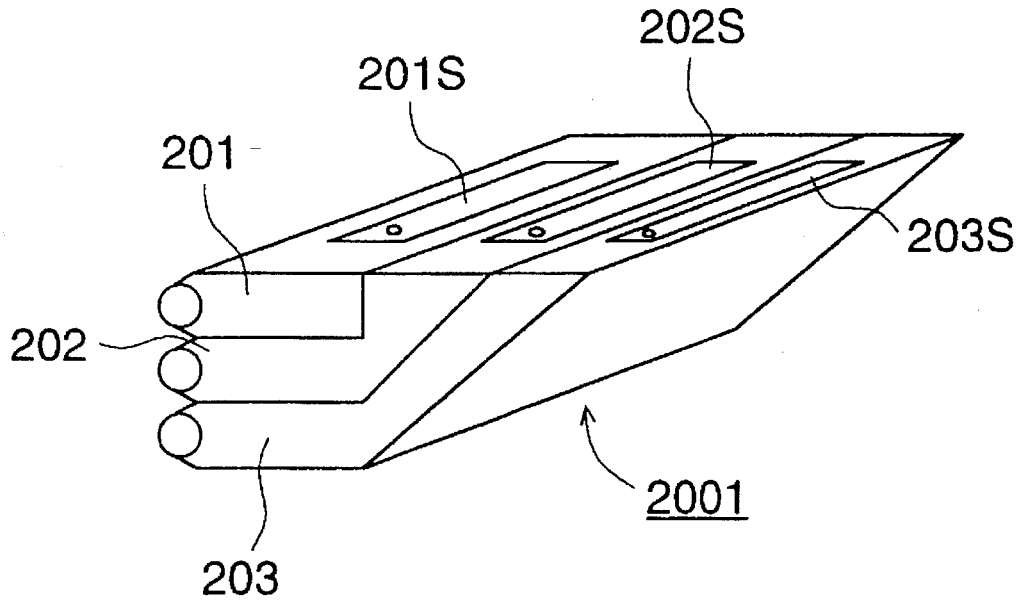
FIG. 3 is a perspective view of an example of a color developer cartridge of the present invention.
Figure 4:
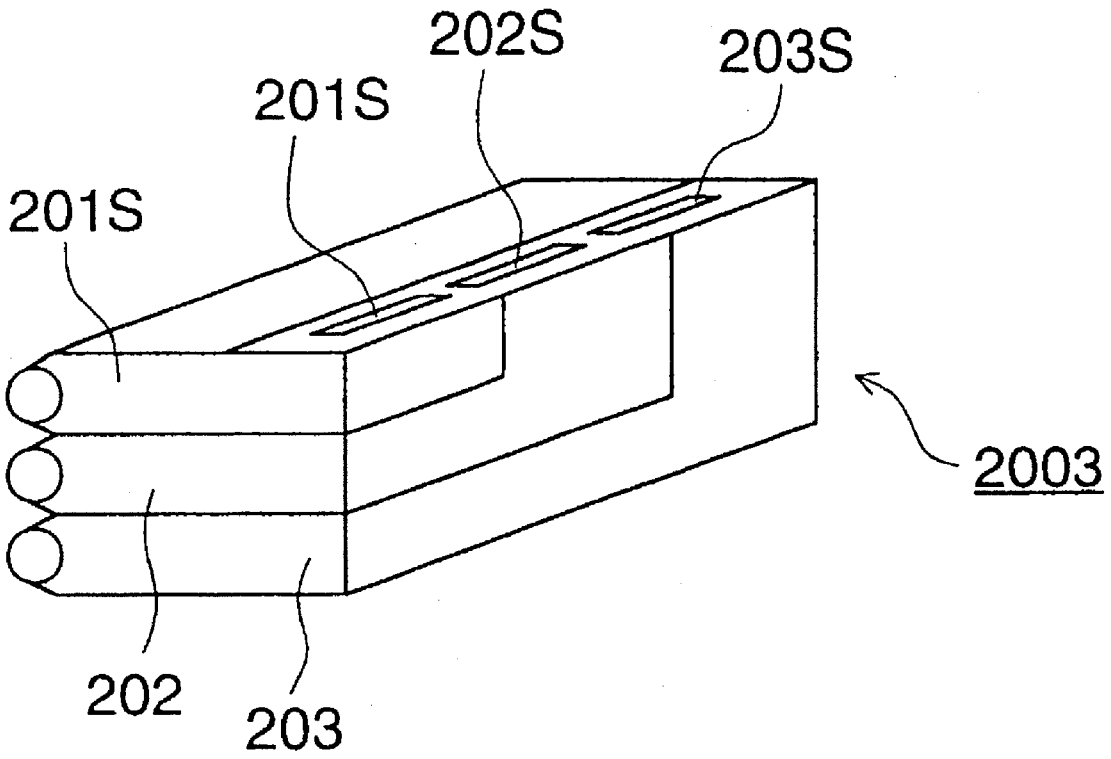
FIG. 4 is a perspective view of an example of a color developer cartridge of the present invention.

Further, the color developer cartridge 2004 into which color developing units 201, 202 and 203 are integrated, and the color developer cartridges 2001 and 2003 into which toner hoppers 201H, 202H and 203H and replenishing ports 201S, 202S and 203S of the toner hoppers are incorporated, are shown in perspective views shown in FIGS. 2, 3 and 4.

As described above, in the first example, the color developer cartridge 2001, 2003 or 2004 and the process cartridge composed of at least the photoreceptor drum 100, black toner hopper 204H, black developing unit 204 to which toner is supplied from the hopper 204H, and screw pipe 32204P with which the developing unit 204 is connected to the hopper 204H, are provided in the main body 10. The process cartridge 2102 and the color developer cartridge 2001, 2003 or 2004 are provided close to the sleeve roller 206 and the surface of the photoreceptor drum 100. Accordingly, it should be considered that the photoreceptor is not damaged when both cartridges are detached from and attached to the main body 10. Therefore, in the case of the detachment and attachment, the color developer cartridge has priority so as not to interfere with the process cartridge. When a process cartridge 2105 or 2106 is attached to and detached from the main body 10 in the same direction C with respect to the rotation axis of the photoreceptor drum 100 or that of the photoreceptor belt 101 as shown in side views in FIGS. 30 and 31, and the color developer cartridge 2001, 2003 or 2004 is attached to and detached from the main body 10 in the perpendicular direction L to the above-described rotation axis through the window 13, the process cartridge including the photoreceptor has priority in the case of the attachment, and the color developer cartridge 2001, 2003 or 2004 has priority in the case of the detachment, which is advantageous for the apparatus. Here, in the perspective view shown in FIG. 6, the color developer cartridge 2004 shown in the perspective view in FIG. 2 is attached to the apparatus and other portions are the same as those in FIG. 5.

Figure 5:
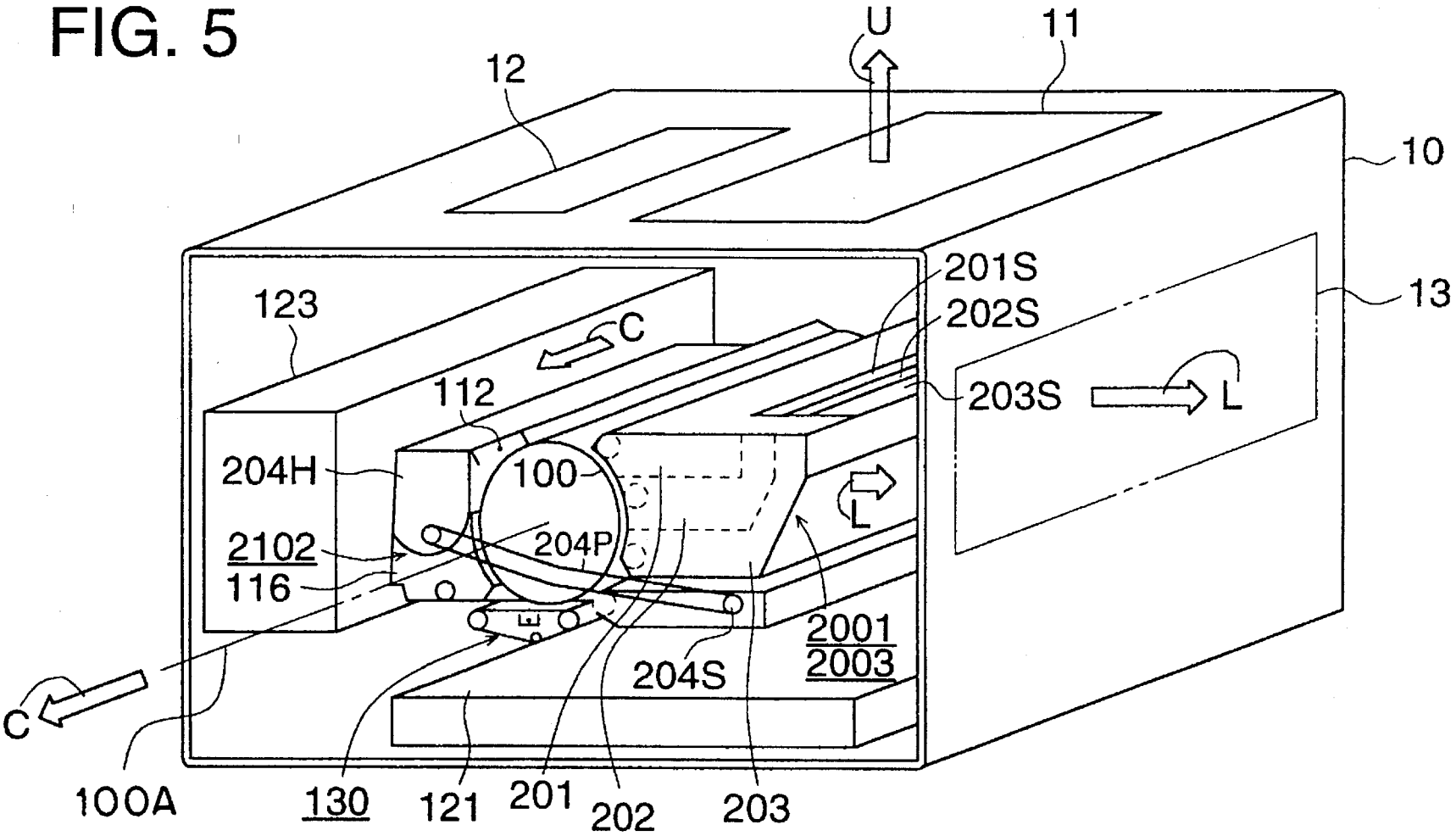
FIG. 5 is a perspective view of an example of the present invention.
Figure 6:
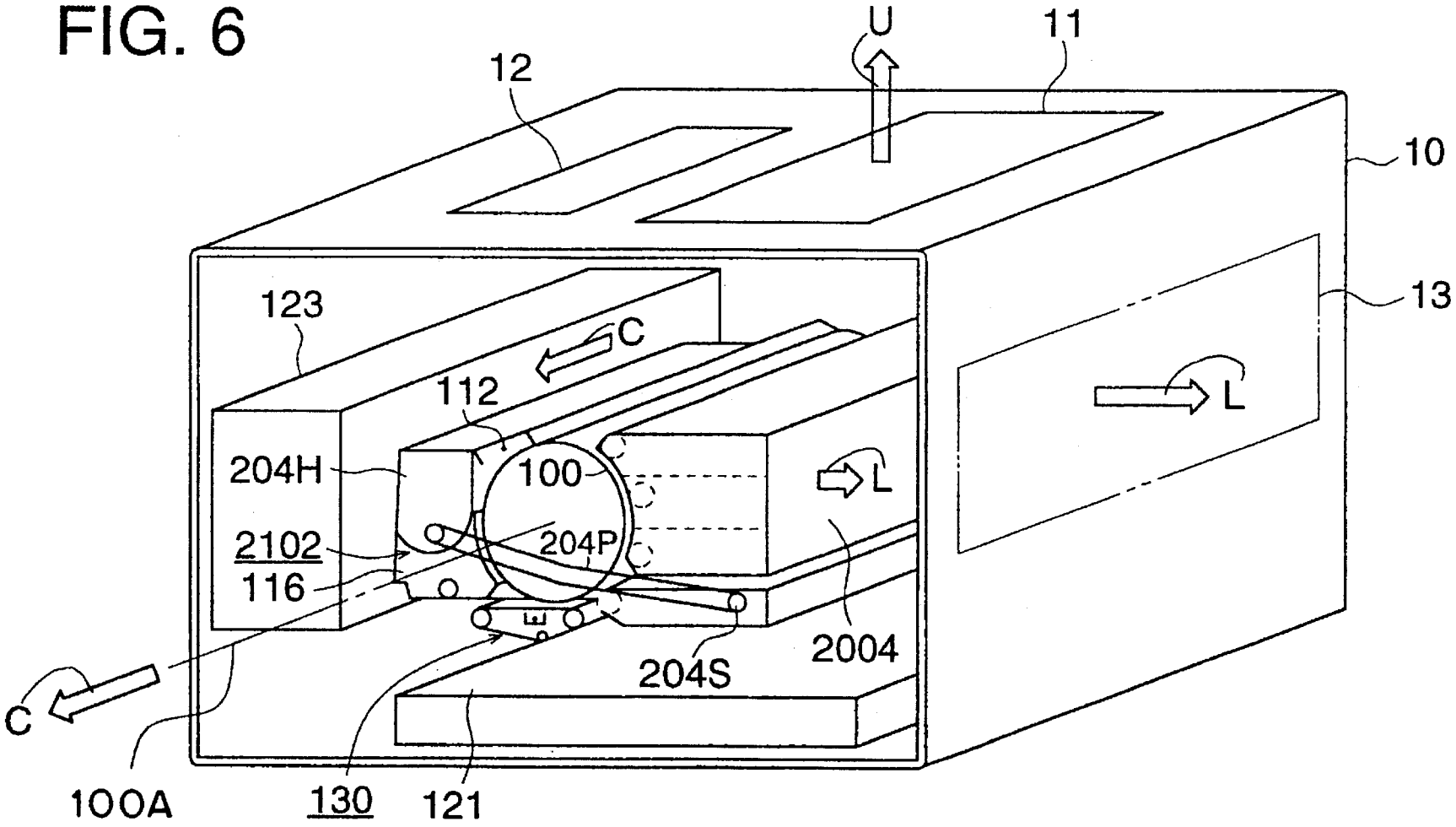
FIG. 6 is a perspective view of an example of the present invention.

In the second example of the present invention, the color developer cartridge 2001, 2003 or 2004 is attached to and detached from the main body through the window 11 in the upper direction U of the main body 10 as shown in FIGS. 5 and 6.

Figure 22:
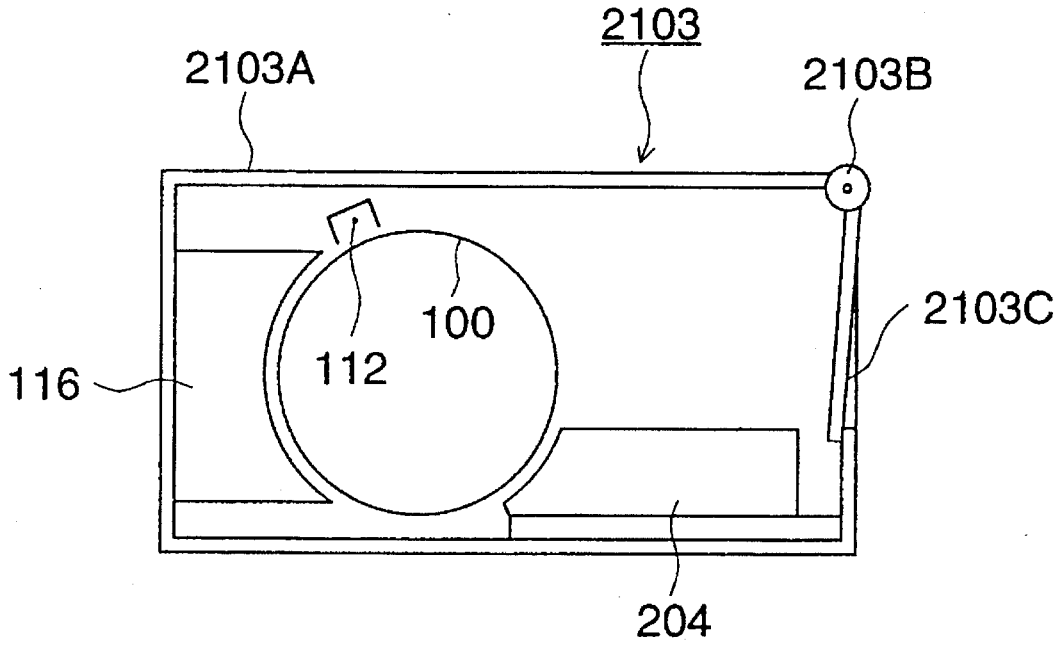
FIG. 22 is a side view of an example expressing the condition in which a shielding plate for photoreceptor light fatigue prevention is provided in the process cartridge.

In the third example of the present invention, when the process cartridge or the color developer cartridge is attached to and detached from the main body, as shown in side views in FIGS. 21 through 24, a frame body 2103A of the process cartridge 2103 of another example into which the process cartridge 2102 is slightly modified, and a cover 2103C of the frame body 2103A are urged by a spring, and the cover 2103C is pushed upward around a shaft 2103B in the case of the attachment of the color developer cartridge 2004. In the case of the detachment of the color developer cartridge 2004, since the surface of the photoreceptor drum 100 is deteriorated due to light, the cover 2103C is closed and light is shielded as shown in FIG. 22.

Figure 23:
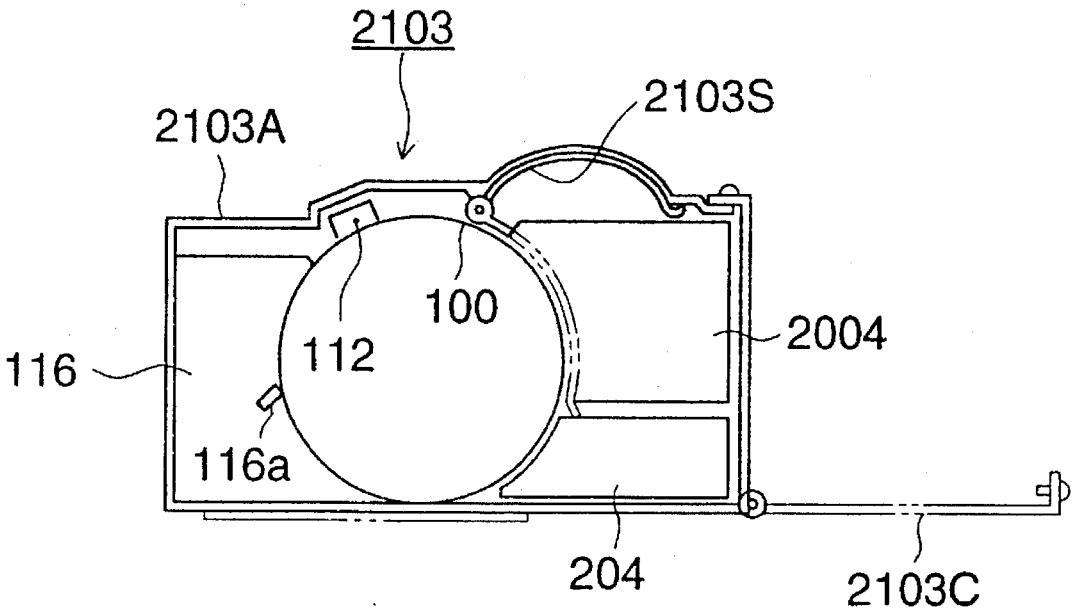
FIG. 23 is a side view of an example expressing the condition in which a shielding plate for photoreceptor light fatigue prevention is provided in the process cartridge.
Figure 24:
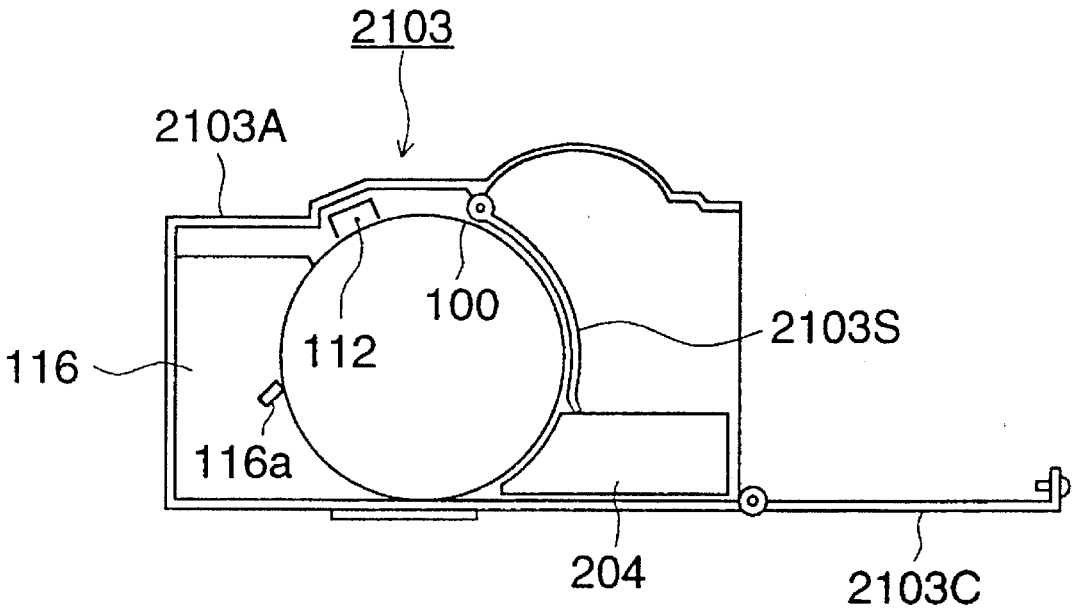
FIG. 24 is a side view of an example expressing the condition in which a shielding plate for photoreceptor light fatigue prevention is provided in the process cartridge.

As shown in FIG. 23, when the color developer cartridge 2004, 2001 or 2003 is attached to the main body 10, since this cartridge shields the surface of the photoreceptor drum 100, a shield plate 2103S is withdrawn to a ceiling portion as shown in FIG. 23. However, when this cartridge is detached from the main body, since the shield plate 2103S shields the surface of the photoreceptor as shown in FIG. 24, the photoreceptor can not be deteriorated by light.

Figure 25:
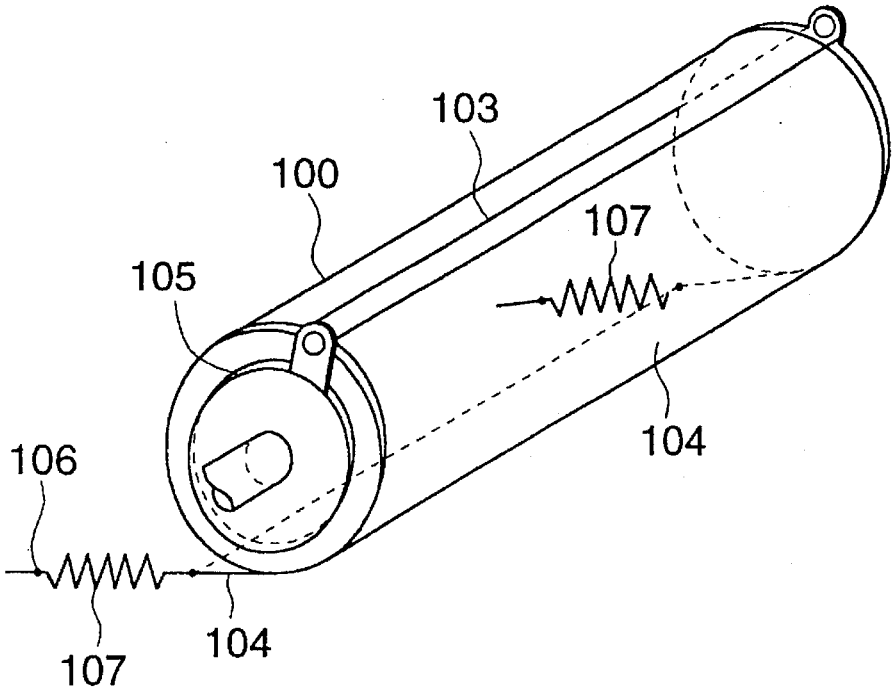
FIG. 25 is a perspective view of the photoreceptor drum having a light shielding screen.
Figure 26:
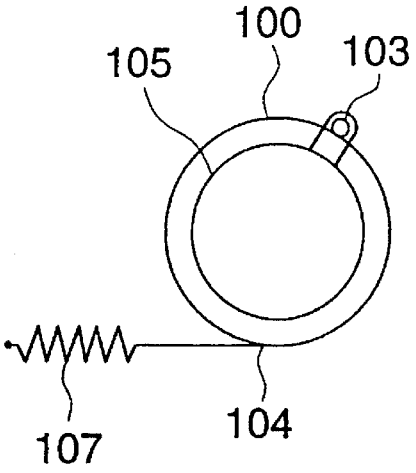
FIG. 26 is a sectional view of the photoreceptor drum having a light shielding screen.
Figure 27:
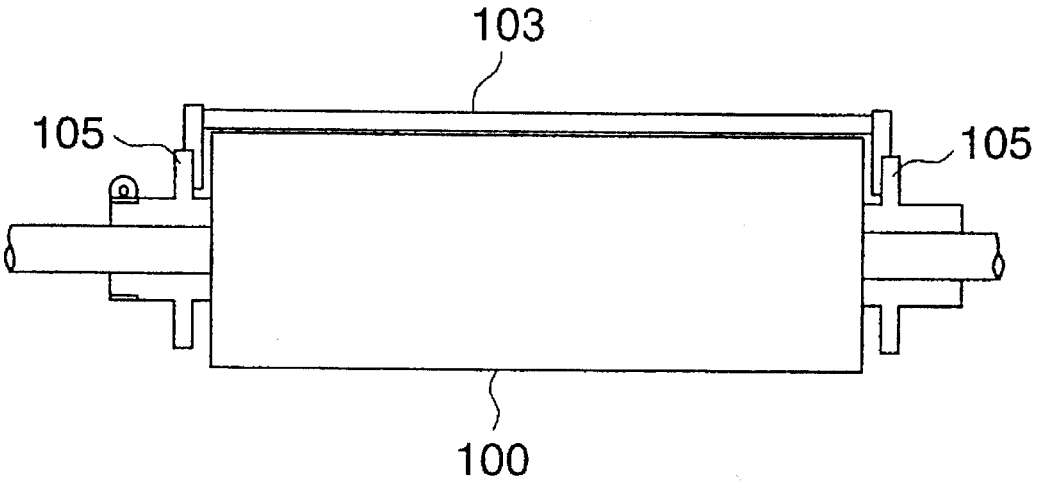
FIG. 27 is a side view of the photoreceptor drum having a light shielding screen.

In a light shielding unit as shown in a perspective view in FIG. 25, sectional view in FIG. 26 and side view in FIG. 27, a light shielding screen 104, which is provided close to the surface of the photoreceptor drum 100, is stretched between both sides of the photoreceptor drum 100 while the light shielding screen 104 is forced by springs 107 one end of which is hooked by a fixed pin 106. When each developing unit is removed, the moving force of a motor (not shown) is transmitted to a rotational disk 105, and thereby, the light shielding screen 104 is wound up or rewound so that the deterioration of the surface of the photoreceptor due to light can be prevented.

One end of the light shielding screen 104 is held by bars 103 fixed to the rotational disks 105 which are provided on both sides of the photoreceptor drum 100 in a concentric relationship with the shaft of the photoreceptor drum 100.

The fourth example of the present invention is structured so that the color developer cartridge and the process cartridge 2102 are fixed to perfectly correct positions when these cartridges are attached to the main body 10.

Figure 28:
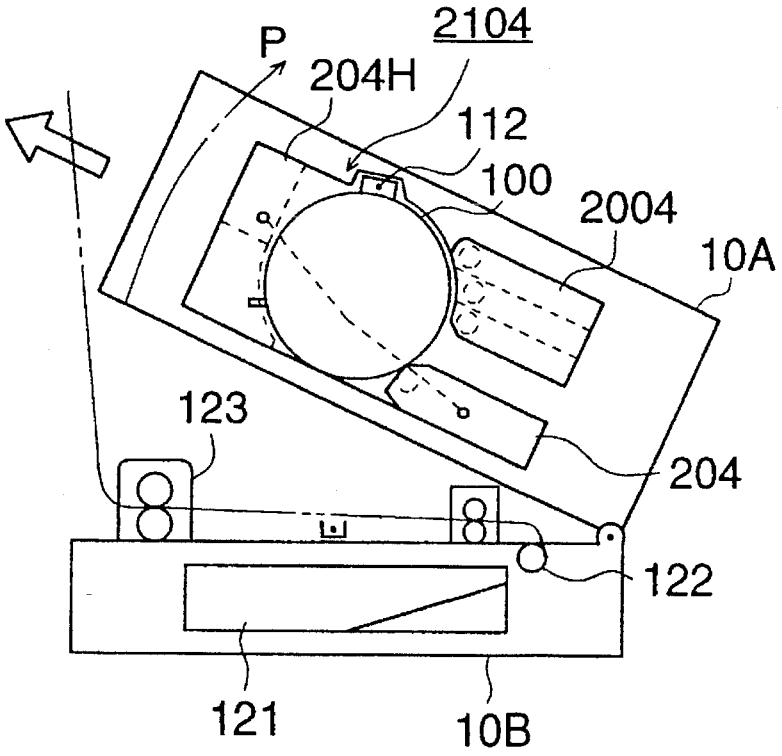
FIG. 28 is a side view of an example of a clam-shell type image forming apparatus.
Figure 29:
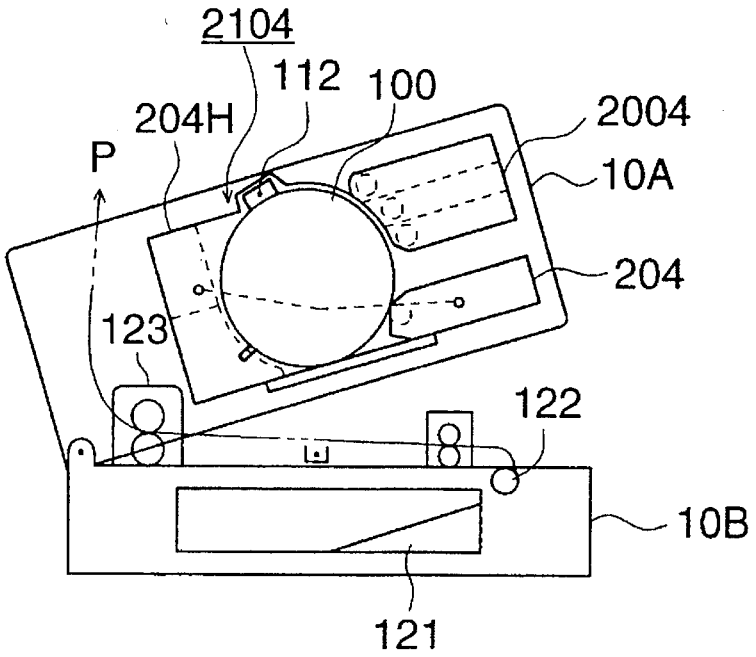
FIG. 29 is a side view of an example of a clam-shell type image forming apparatus.

The foregoing four examples from the first to the fourth can also be applied to the clam-shell type photoreceptor drum type image forming apparatus as shown in FIGS. 28 and 29 in the same manner as the foregoing examples. That is, the direction and sequence of attachment and detachment of the process cartridge 2104 and color developer cartridge 2004 which are attached to an upper main body 10A in another example, and the light shielding means of the photoreceptor can be realized in the same manner as the means shown in FIGS. 5, 6, and 21 through 27.

Further, also in the image forming apparatus using the belt type photoreceptor as shown in FIGS. 30 and 31, the direction and the sequence of the attachment and detachment of the process cartridge 2105 or 2106 and the color developer cartridge 2004 can be realized in the same manner as those in the foregoing examples.

Figure 7:
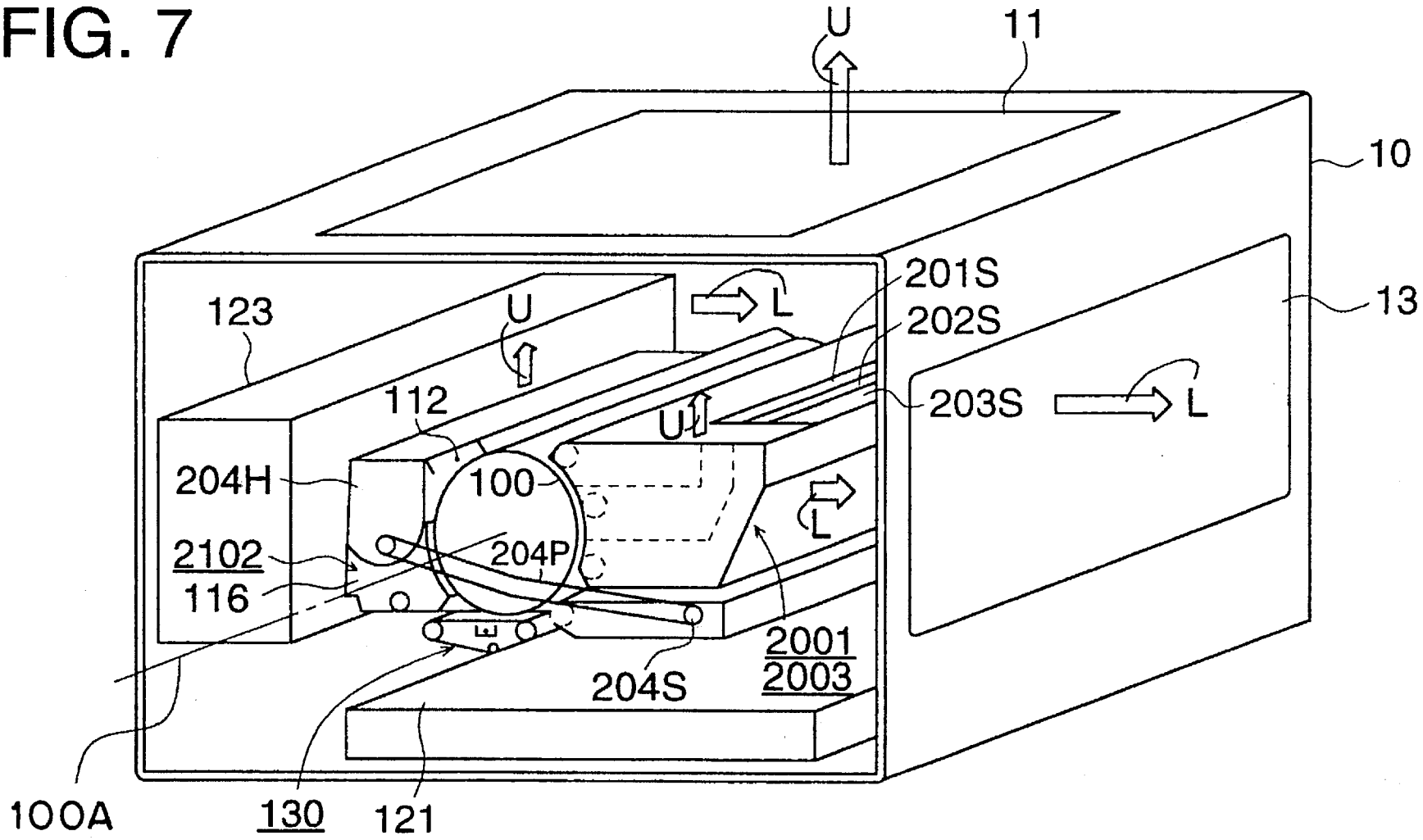
FIG. 7 is a perspective view of an example of the present invention.
Figure 8:
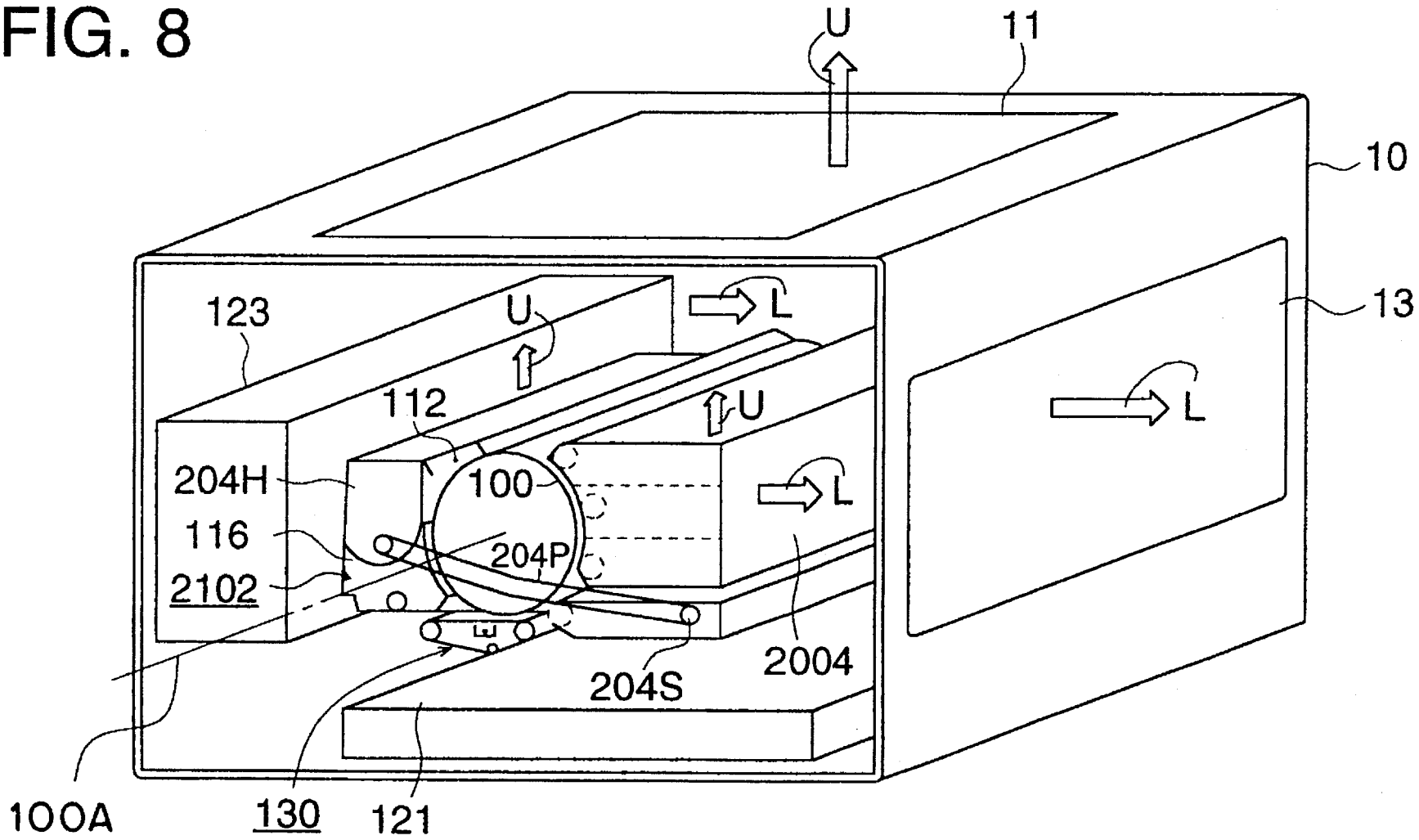
FIG. 8 is a perspective view of an example of the present invention.

In the fifth example of the present invention, as shown by perspective views in FIGS. 7 and 8, when the color developer cartridge 2004, 2001 or 2003 and the process cartridge 2102 are attached to and detached from the main body, these cartridges are detached and attached in the perpendicular direction to the rotation axis of the photoreceptor drum 100 and in the same direction as each other. That is, when the color developer cartridge is detached and attached in the direction of the upper surface U, the process cartridge is also detached and attached in the direction of the upper surface. When the color developer cartridge is detached and attached in the direction of the side L, the process cartridge is also detached and attached in the direction of the side L.

In order to function in the same way as the first example, this example is structured so that the color developer cartridge 2004, 2001 or 2003 does not interfere with the process cartridge when the process cartridge is detached from and attached to the main body. In the case of detachment of these cartridges, the color developer cartridge has the priority, and in the case of attachment, the process cartridge has the priority, so that the photoreceptor can be perfectly protected.

The sixth example of the present invention is simplified so that the attachment and detachment is conducted in the upward direction U of the color image forming apparatus main body 10 as shown by side views in FIG. 7 or FIG. 8. The attachment and detachment of the cartridges are conducted when a cover (not shown) provided in the upper surface of the apparatus main body 10 is opened and a ceiling window 11 is formed.

In the seventh example of the present invention, the attachment and detachment of the cartridges are conducted in the direction in which developing units are located in the main body 10, that is in the direction shown by L in FIG. 7 or FIG. 8. The attachment and detachment is conducted when a cover (not shown) provided on the side of the apparatus main body 10 is opened and an opening 13 is formed.

The shielding means of the photoreceptor surface realized in the third example is applied to the eighth example of the present invention in the same manner as that in the third example.

The ninth example of the present invention is structured as follows. In the case of attachment of the color developer cartridge and the process cartridge, these cartridges are clamped so as to be perfectly attached to the main body, and in an accurately attached condition, the color image forming apparatus can be correctly operated, and high quality image formation can be conducted.

The five examples from the fifth to the ninth can also be applied to the clam-shell type photoreceptor drum type image forming apparatus as shown in FIGS. 28 and 29. That is, the direction and sequence of attachment and detachment of the process cartridge 2101 and the color developer cartridge 2004 in other examples which are attached to an upper main body 10A, and the light shielding means of the photoreceptor can also be realized in the same manner as those shown in FIGS. 7, 8, and 21 through 27.

The direction and sequence of the attachment and detachment of the process cartridge 2105 and the color developer cartridge 2004 can also be applied to the image forming apparatus using the belt type photoreceptor as shown in FIGS. 30 and 31 in the same manner as those in the foregoing examples.

However, in FIG. 30, when these cartridges are detached and attached in the upward direction, it is necessary that the sheet feed cassette and the sheet feed guide including the transfer electrode are drawn out in an upward direction in advance. In FIG. 31, it is necessary that the optical system unit is drawn out upward in advance.

Figure 9:
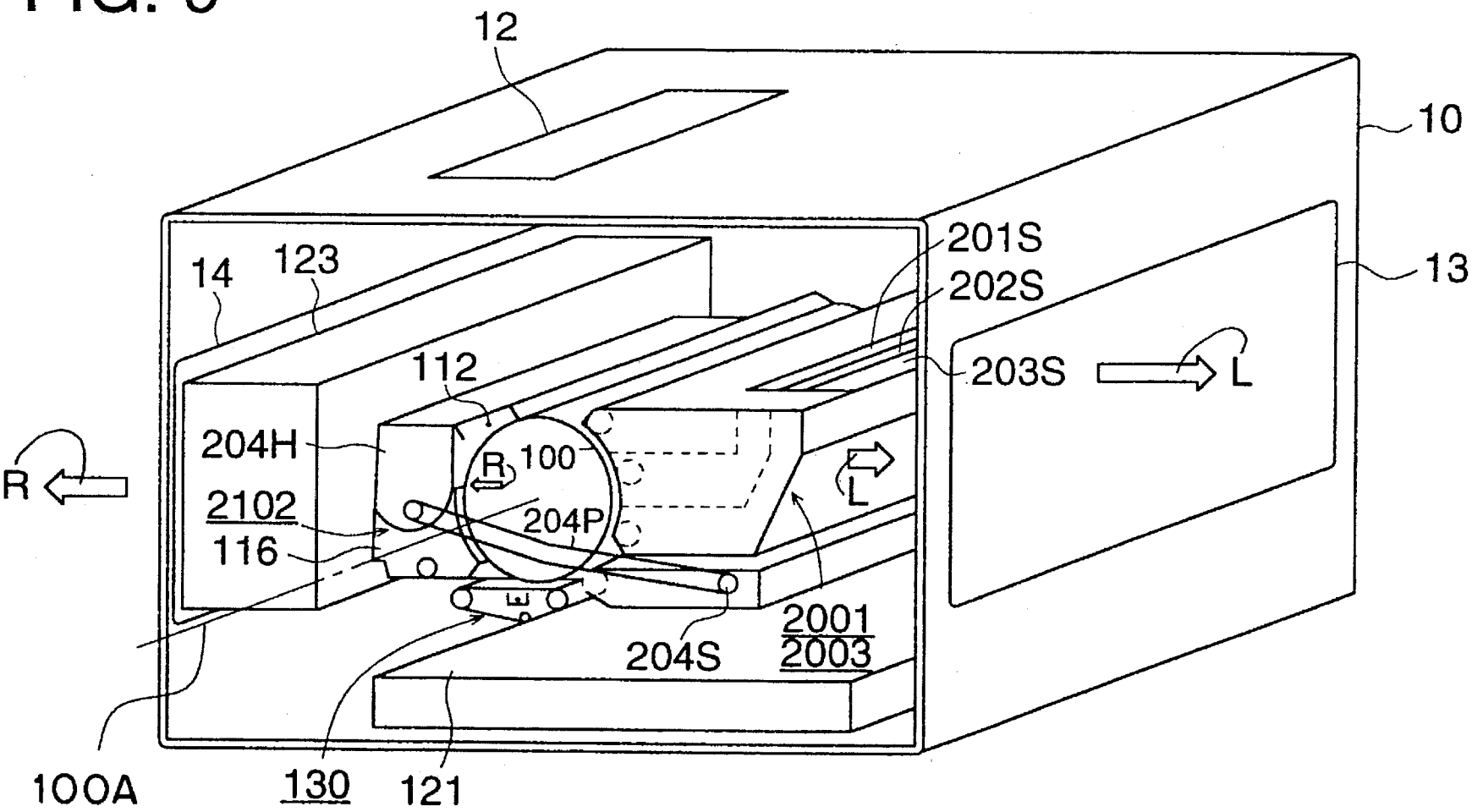
FIG. 9 is a perspective view of an example of the present invention.
Figure 10:
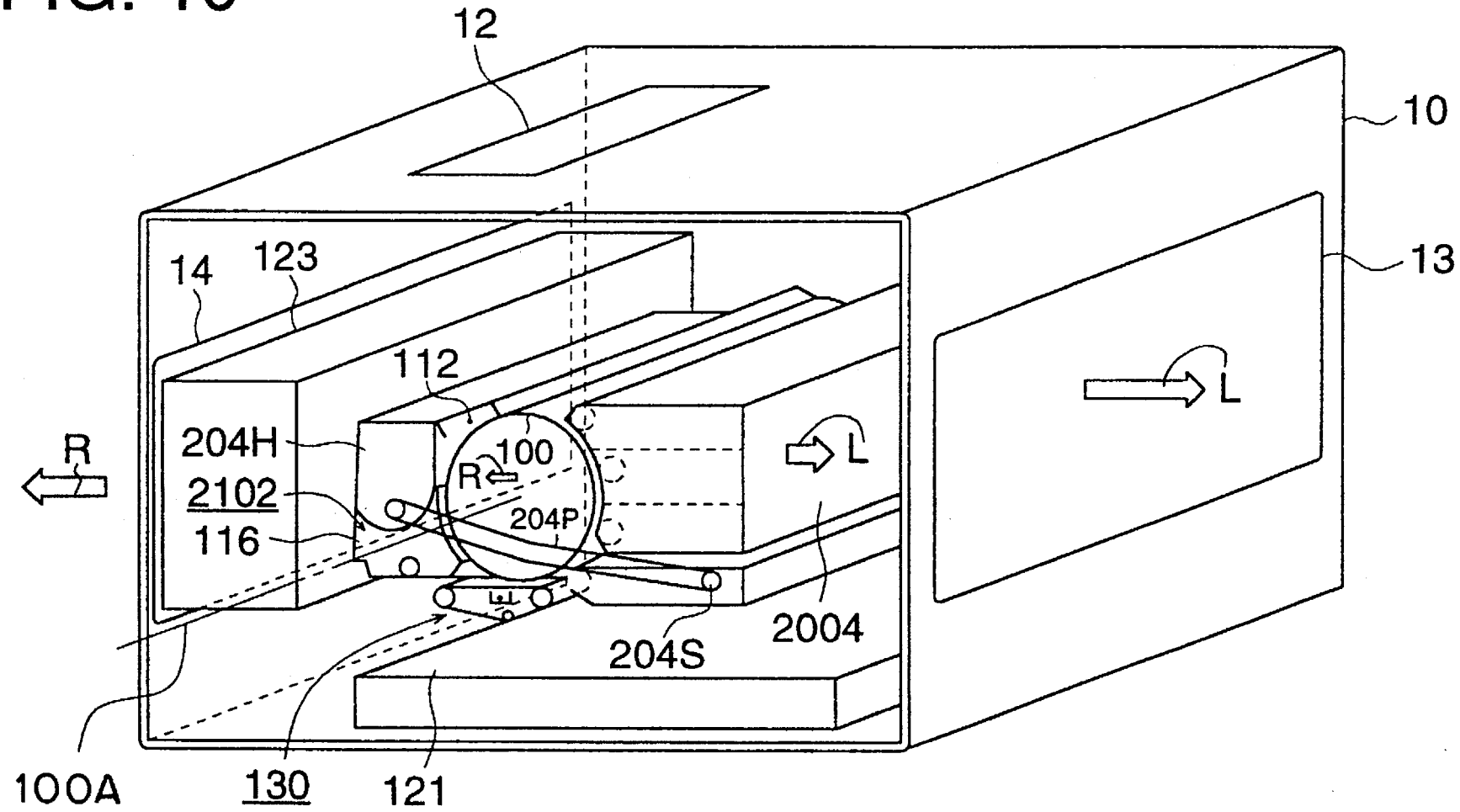
FIG. 10 is a perspective view of an example of the present invention.

As shown by perspective views in FIGS. 9 and 10, the tenth example of the present invention is structured as follows: the color developer cartridge 2004, 2001, or 2003 and the process cartridge 2102 are structured so that both these cartridges can be attached to and detached from the main body 10; the direction of the attachment and detachment of both cartridges is perpendicular to the rotation axis of the photoreceptor, and these operations are conducted in the direction in which these cartridges are separated from each other; when the process cartridge is attached to and detached from the main body in the direction of one side R, the color developer cartridge is attached to and detached from the main body 10 in the direction of the other side L; the color developer cartridge has priority in the case of detachment; and the process cartridge has priority in the case of attachment.

The eleventh example of the present invention is structured as follows: as shown by perspective views in FIG. 5 or FIG. 6 in the tenth example, the color developer cartridge is attached and detached in the direction of the side L of the color image forming apparatus main body 10 so that the color developer cartridge does not interfere with the process cartridge and both cartridges can be easily and correctly attached to and detached from the main body. The color developer cartridge is attached to and detached from the main body through the opening 13 formed on one side of the apparatus main body 10 and the process cartridge is attached to and detached from the main body together with the fixing unit 123 through the opening 14 formed on the other side.

In the twelfth example of the present invention, a shielding member is provided with respect to the process cartridge, and the photoreceptor can be protected by the same means as those described in the third example and the eighth example.

The thirteenth example is structured as follows. When the process cartridge and the color developer cartridge, which are attached to and detached from the main body as described above, are respectively attached to the main body, these cartridges are accurately fixed to predetermined positions so that a stable high quality image can be obtained.

The foregoing four examples from the tenth to the thirteenth can be applied to the clam-shell type photoreceptor drum type image forming apparatus as shown in FIGS. 28 and 29 in the same manner as described above. That is, the direction and sequence of attachment and detachment of the process cartridge 2101 and the color developer cartridge 2004 in other examples which are attached to an upper main body 10A, and the light shielding means of the photoreceptor can also be realized in the same manner as those shown in FIGS. 9, 10, and 21 through 27. However, in the case of FIG. 29, it is necessary that the fixing unit 123 provided in the lower main body 10B is removed in advance.

The direction and sequence of the attachment and detachment of the process cartridge 2105 or 2106 and the color developer cartridge 2004 can also be applied to the image forming apparatus using the belt type photoreceptor as shown in FIG. 30 in the same manner as those in the foregoing examples.

However, in the case of FIG. 30, when the color developer cartridge 2004 is attached and detached in the direction of one side L, and the process cartridge 2101 is attached and detached in the direction of the other side, it is necessary that the image exposure means 113 and the fixing unit 123 are drawn out in advance. In the case of FIG. 31, this example 13 can not be realized.

Figure 11:
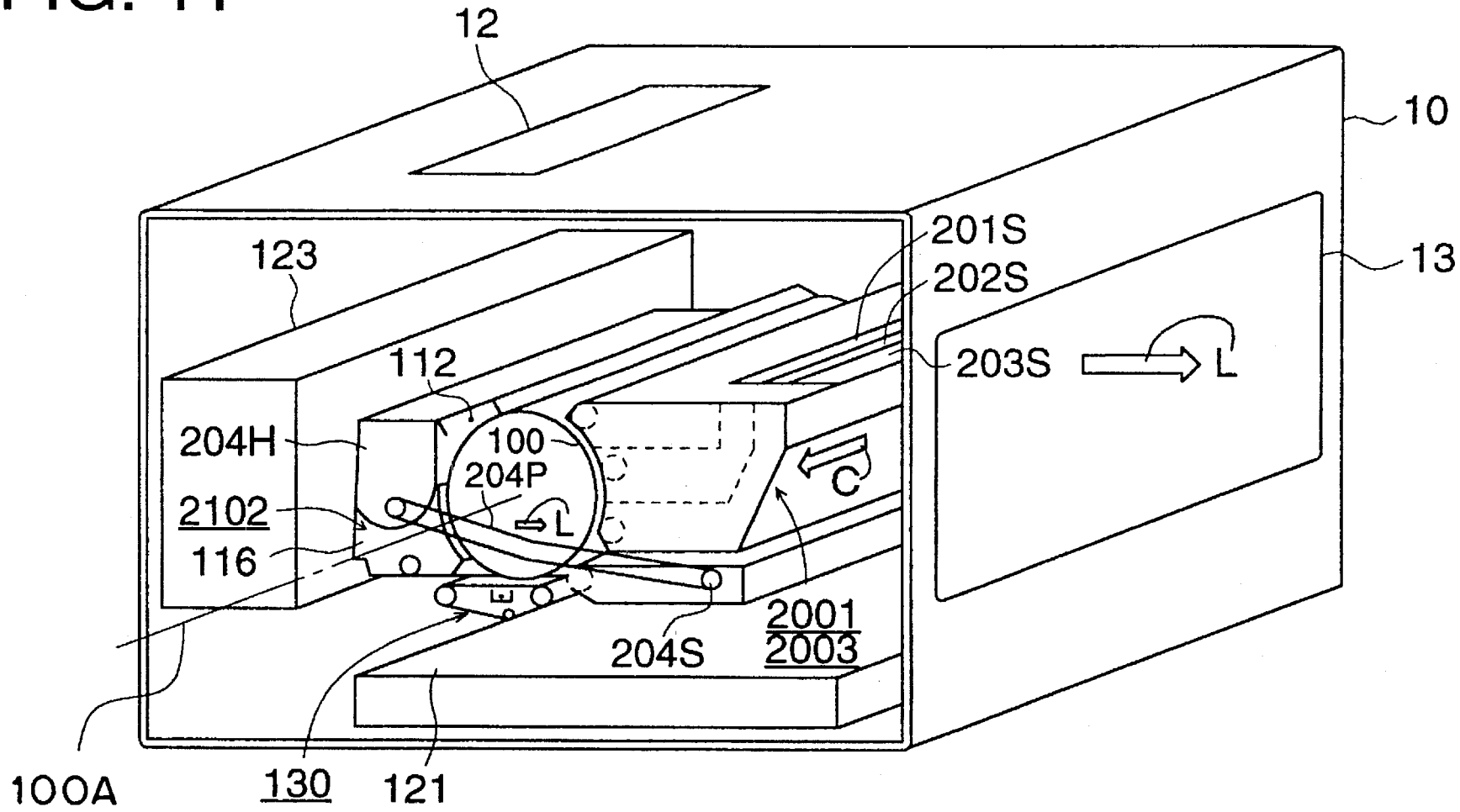
FIG. 11 is a perspective view of an example of the present invention.
Figure 12:
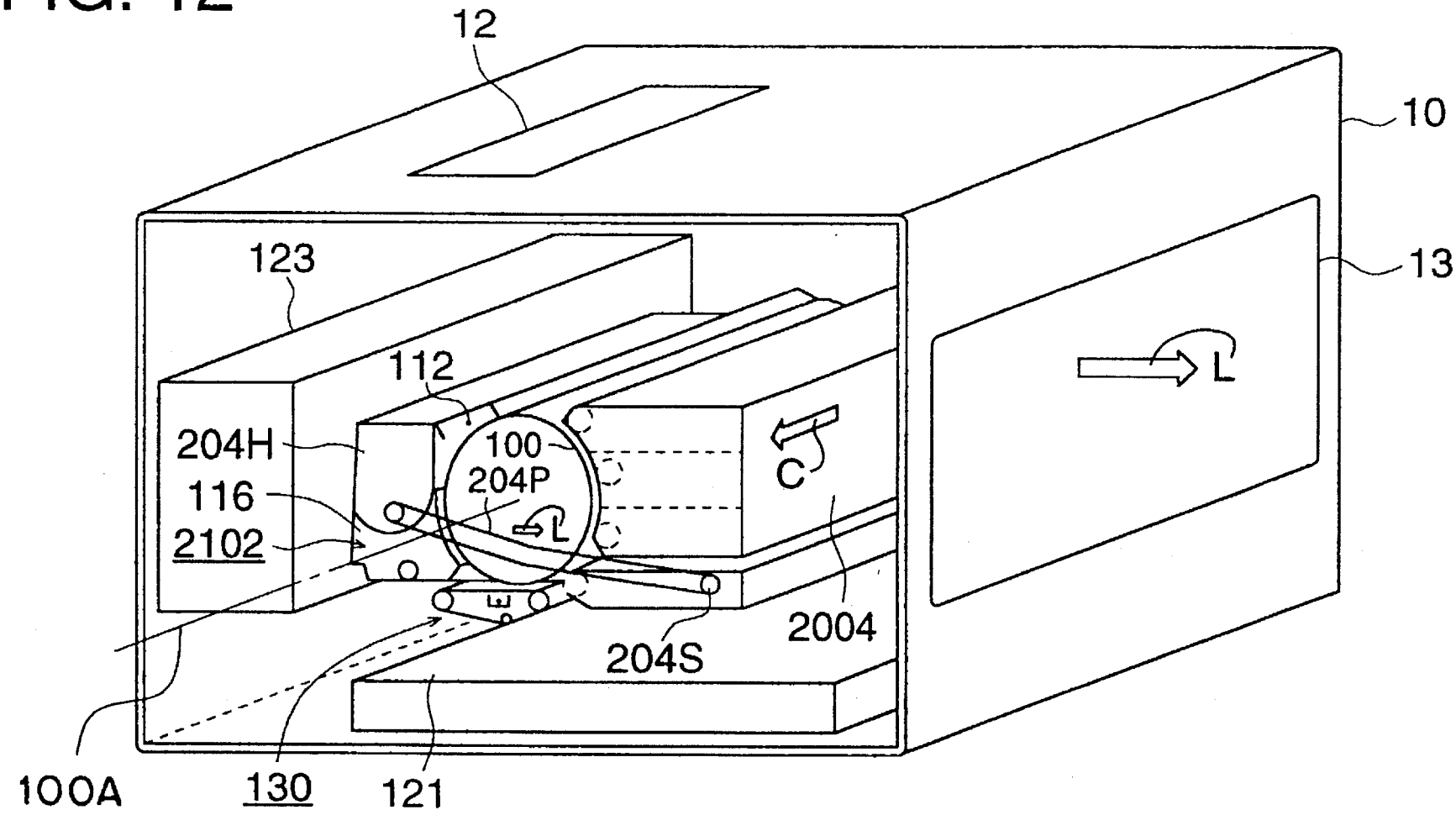
FIG. 12 is a perspective view of an example of the present invention.

As shown by perspective views in FIGS. 11 and 12, the fourteenth example of the present invention is structured as follows. When the color developer cartridge 2004, 2001 or 2003 and the process cartridge 2102 are attached to and detached from the main body, the attachment and detachment of the process cartridge is conducted in the perpendicular direction to the rotation axis of the photoreceptor drum 100 and in the direction of the side on which the color developer cartridge is positioned, that is, in the direction L in the drawing, and the attachment and detachment of the color developer cartridge is conducted in the direction C of the rotation axis of the photoreceptor drum 100.

The process cartridge 2102 is attached to and detached from the main body 10 through the opening 13 provided on the main body 10.

The process cartridge and the color developer cartridge are attached to and detached from the main body in the perpendicular direction to each other. When these cartridges are attached to and detached from the main body, these cartridges interfere with each other when left as these are. The process cartridge has the priority in the case of attachment, and the color developer cartridge has the priority in the case of detachment so that these cartridges can not damage each other.

In the fifteenth example, the attachment and detachment of the color developer cartridge is conducted not in the direction toward the front but in the left and right direction of the color image forming apparatus main body 10.

In the sixteenth example, the shielding member for shielding and unshielding the surface of the photoreceptor in the process cartridge in the fourteenth example which is opposed to the color developer cartridge, is provided in the same manner as described in the third example. Thereby, the deterioration of the photoreceptor by light can be prevented.

The seventeenth example of the present invention is structured as follows. In the case of attachment of the process cartridge and the color developer cartridge described in the fourteenth example, these cartridges are positively fixed to a correct position and clamped, and thereby high quality image formation can be conducted.

The four examples from the fourteenth to the seventeenth can also be applied to the clam-shell type photoreceptor drum type image forming apparatus as shown in FIGS. 28 and 29. That is, the direction and sequence of attachment and detachment of the process cartridge 2101 and the color developer cartridge 2004 in other examples which are attached to an upper main body 10A, and the light shielding means of the photoreceptor can also be realized in the same manner as those shown in FIGS. 11, 12, and 21 through 27.

The direction and sequence of the attachment and detachment of the process cartridge 2105 or 2106 and the color developer cartridge 2004 can also be applied to the image forming apparatus using the belt type photoreceptor as shown in FIG. 30 in the same manner as those in the foregoing examples.

Figure 13:
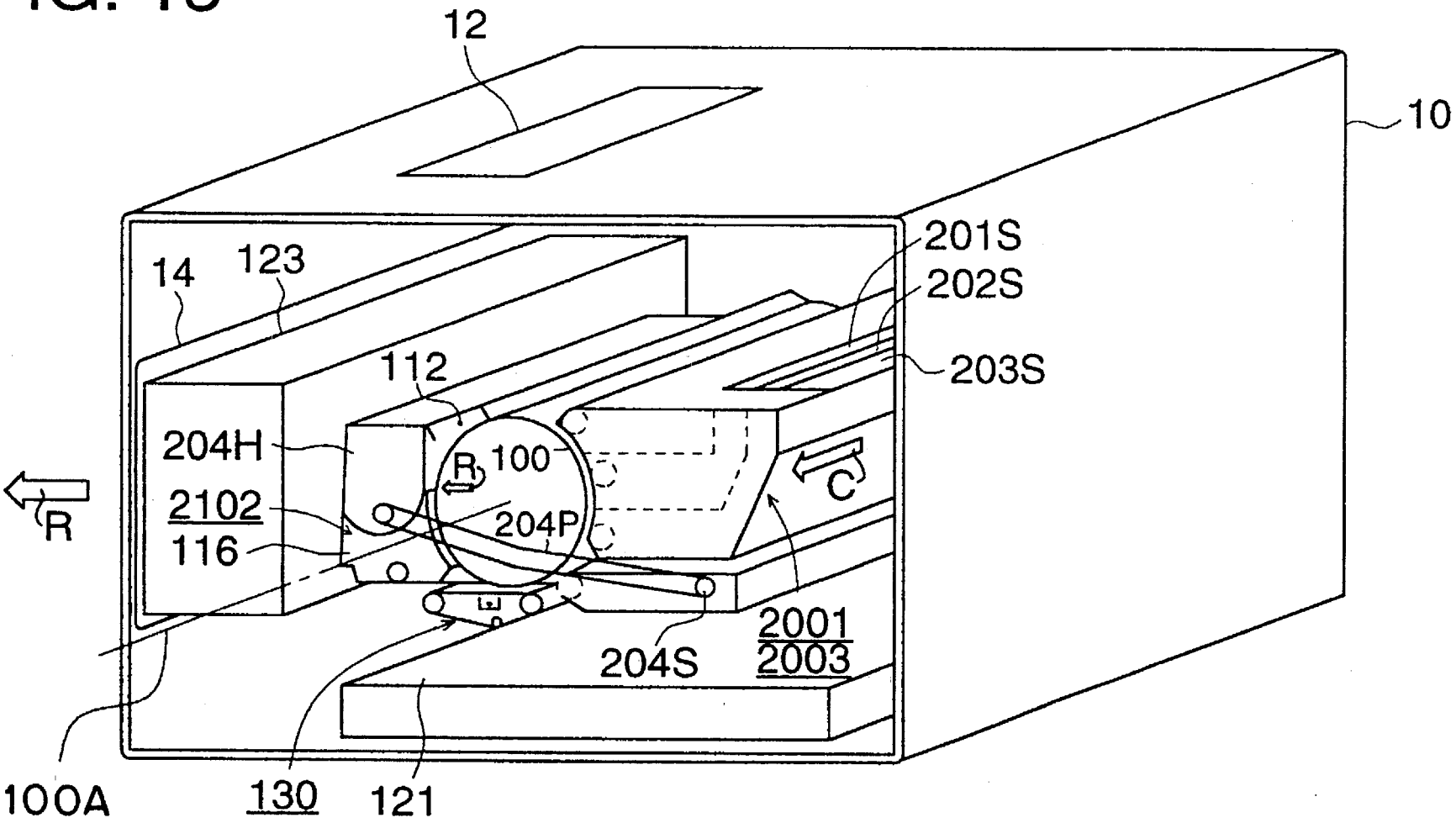
FIG. 13 is a perspective view of an example of the present invention.
Figure 14:
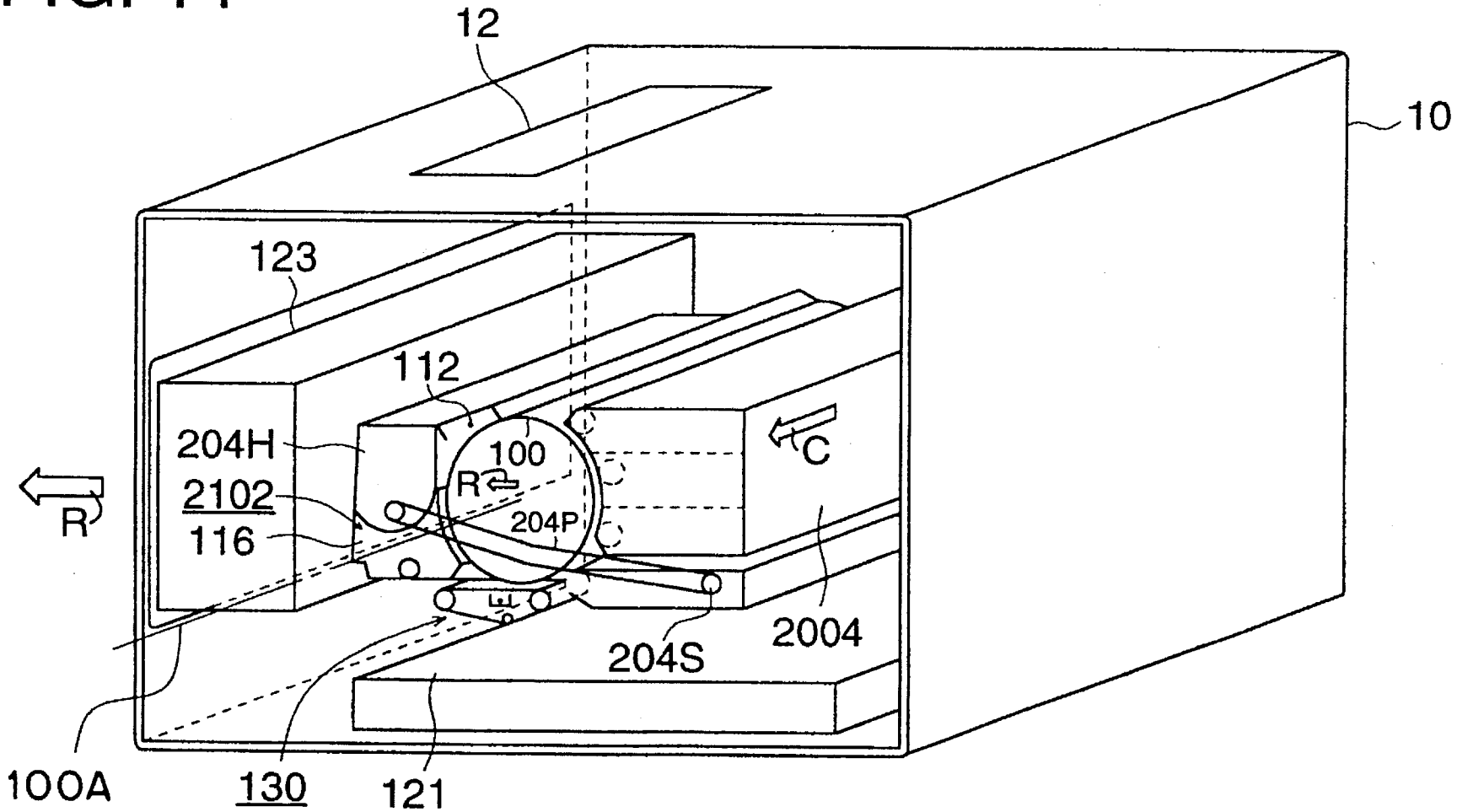
FIG. 14 is a perspective view of an example of the present invention.

The eighteenth example of the present invention is structured as follows. As shown by perspective views in FIGS. 13 and 14, the direction of attachment and detachment of the process cartridge 2102 is perpendicular to the rotation axis of the photoreceptor 100 and opposed to the color developer cartridge 2001, 2003 or 2004, that is, the direction of R shown in FIGS. 13 and 14; and the direction of the attachment and detachment of the color developer cartridge is parallel with the rotation axis of the photoreceptor. The process cartridge and the color developer cartridge interfere with each other, and the priority of the attachment and the detachment of these cartridges is opposite to that in the fourteenth example, so that the cartridges can not damage each other. When the process cartridge is attached to and detached from the main body, the fixing unit 123 is also attached and detached together with the cartridge through the opening 14.

In the nineteenth example, the direction of the attachment and detachment of the color developer cartridge is limited in the manner that the direction is toward the side of the color image forming apparatus as shown in FIGS. 5 and 6.

The twentieth example is structured in the same manner as the third example and as follows. The shielding member for shielding and unshielding the photoreceptor drum surface opposed to a sleeve roller 206 in the process cartridge is provided in the process cartridge for light-shielding. Thereby, the surface of the photoreceptor can not be deteriorated by light.

The twenty first example of the present invention is structured as follows. When the process cartridge and the color developer cartridge are attached to the main body 10, these cartridges are positively clamped and fixed to a correct position, and thereby, high quality image formation can be conducted in the color image forming apparatus shown in the eighteenth example.

The examples from the eighteenth to the twenty first can be applied to the clam-shell type photoreceptor drum type image forming apparatus as shown in FIGS. 28 and 29 in the same manner as described above. That is, the direction and sequence of attachment and detachment of the process cartridge 2101 and the color developer cartridge 2004 in other examples which are attached to an upper main body 10A and the light shielding means of the photoreceptor can also be realized in the same manner as those shown in FIGS. 13, 14, and 21 through 27. However, in the case of FIG. 29, it is necessary that the fixing unit 123 provided in the lower main body 10B is removed in advance.

The direction and sequence of the attachment and detachment of the process cartridge 2105 or 2106 and the color developer cartridge 2004 can also be applied to the image forming apparatus using the belt type photoreceptor as shown in FIGS. 30 and 31 in the same manner as those in the foregoing examples.

However, in FIG. 30, when these cartridges are detached and attached in the upward direction, that is, in the opposite direction to the color developer cartridge, it is necessary that the sheet feed cassette and the sheet feed guide including the transfer electrode are removed upward in advance. In FIG. 31, it is necessary that the optical system unit is drawn out upward first.

Figure 15:
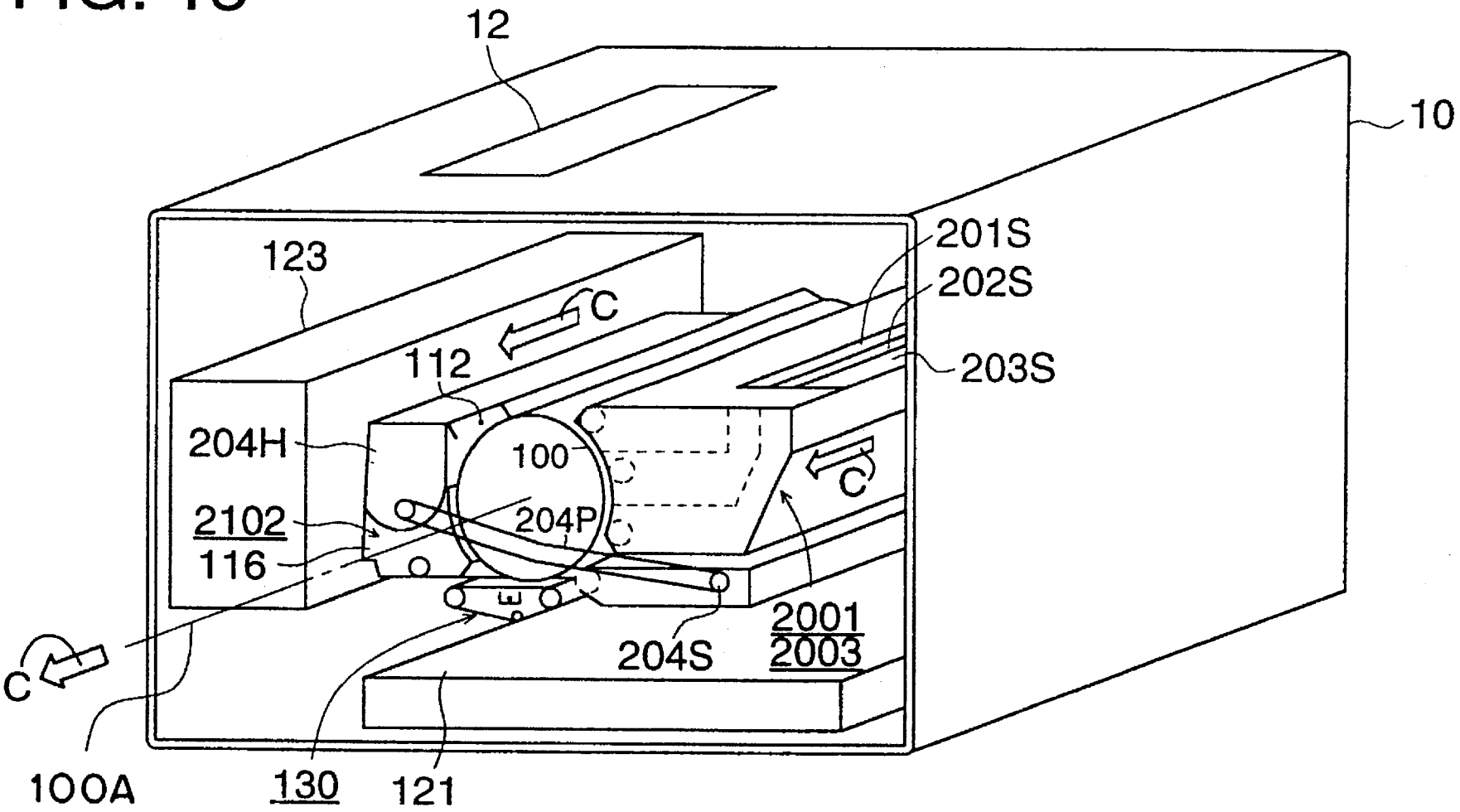
FIG. 15 is a perspective view of an example of the present invention.
Figure 16:
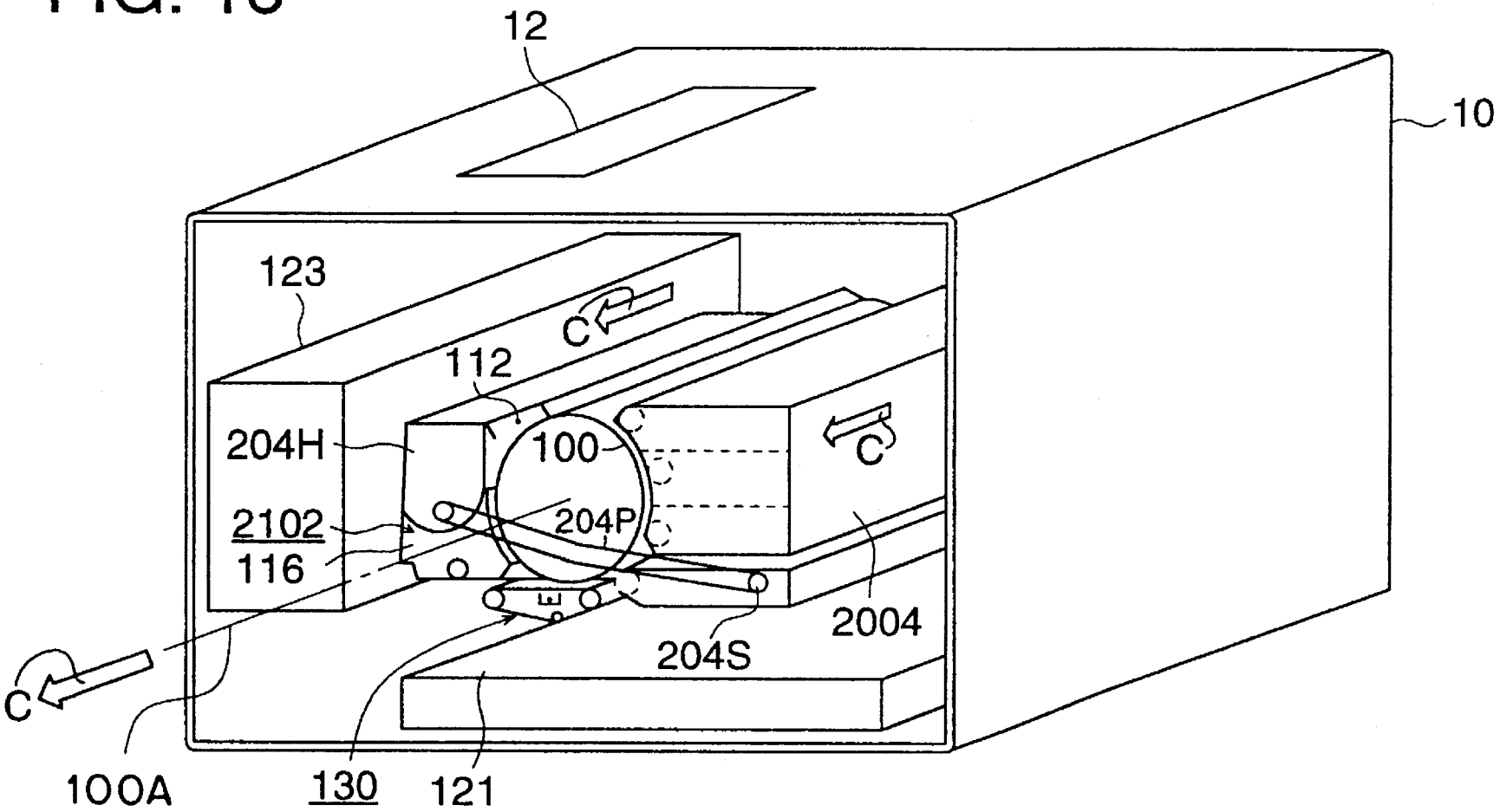
FIG. 16 is a perspective view of an example of the present invention.
Figure 17:
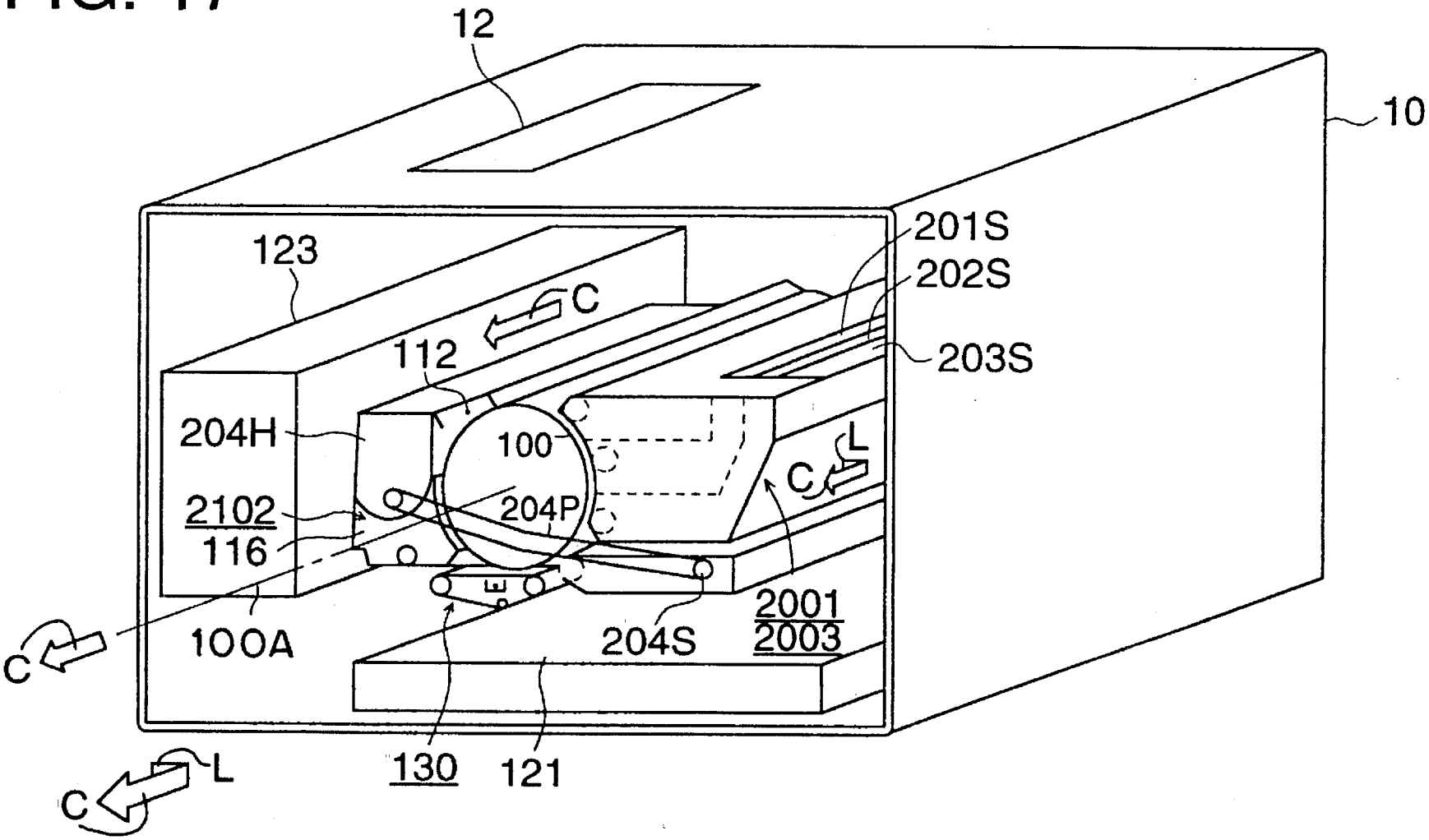
FIG. 17 is a perspective view of an example of the present invention.
Figure 18:
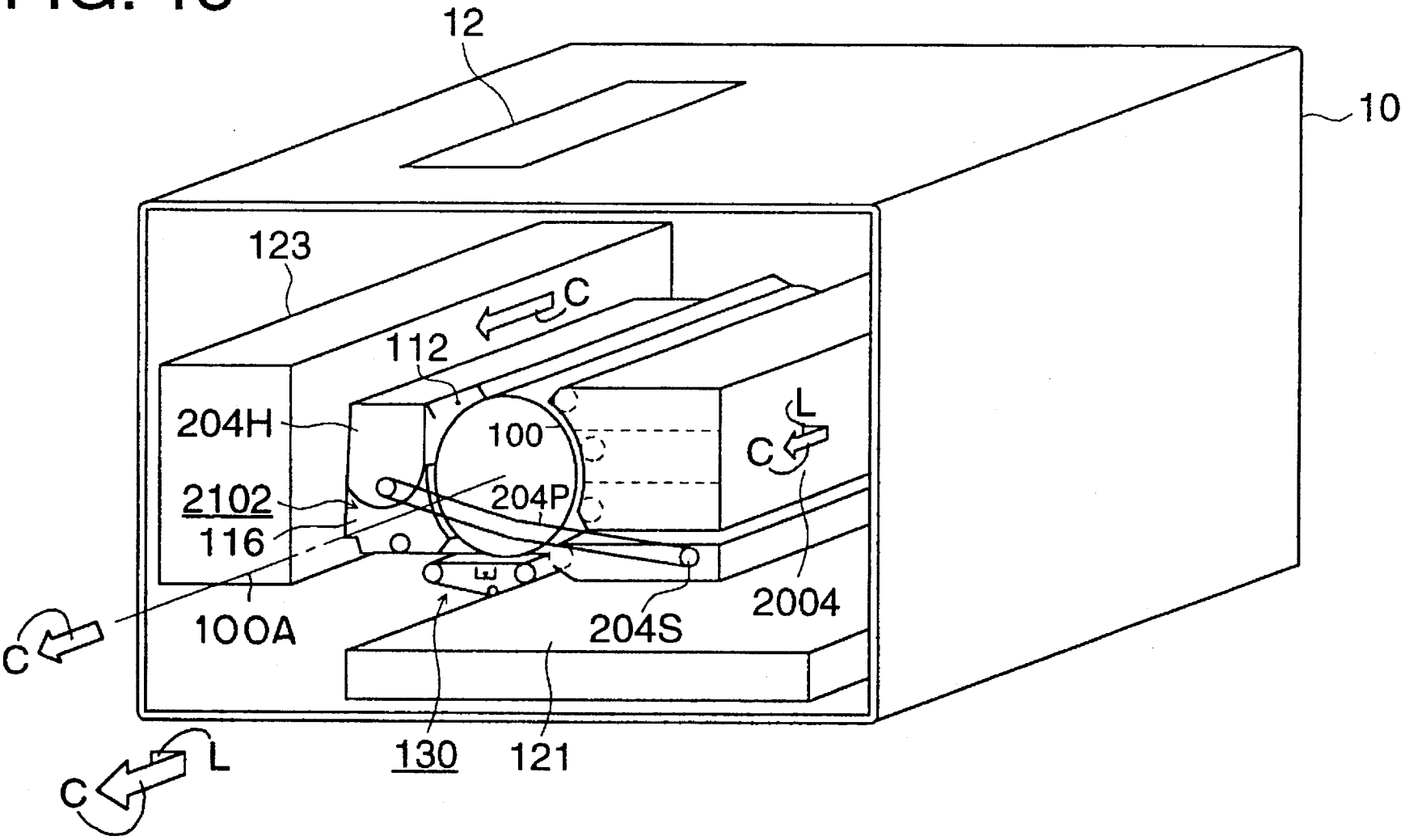
FIG. 18 is a perspective view of an example of the present invention.

As shown by perspective views in FIGS. 15 and 16, the twenty second example of the present invention is structured as follows. The process cartridge 2102 and the color developer cartridge 2001, 2003, or 2004 are structured so that both these cartridges can be attached to and detached from the main body 10 in the parallel direction with the rotation axis of the photoreceptor drum 100 and in the same attachment and detachment directions. Both cartridges interfere with each other when left as these are, in the case of detachment, the color developer cartridge has the priority, and in the case of attachment, the process cartridge has the priority.

Thereby, operations such as maintenance, inspection and replacement operations can be easily carried out.

Although the twenty third example of the present invention is approximately the same as the twenty second example, when the process cartridge is attached to and detached from the main body, the attachment and detachment operations are carried out after the color developer cartridge has been first withdrawn a little in the perpendicular direction to the rotation axis, so that these cartridges can not damage each other.

In the twenty fourth example of the present invention, the shielding member for shielding and unshielding the surface of the photoreceptor as shown in the third example is provided in addition to the twenty second example or twenty third example. Thereby, the deterioration of the photoreceptor by light can be prevented.

The twenty fifth example of the present invention is structured as follows. In the case of attachment of the process cartridge and the color developer cartridge, these cartridges are positively fixed to a correct position and clamped in addition to three examples from the twenty second to the twenty fourth, thereby high quality image formation can be conducted.

The four examples from the twenty second to the twenty fifth can also be applied to the clam-shell type photoreceptor drum type image forming apparatus as shown in FIGS. 28 and 29. That is, the direction and sequence of attachment and detachment of the process cartridge 2101 and the color developer cartridge 2004 in other examples which are attached to an upper main body 10A, and the light shielding means of the photoreceptor can also be realized in the same manner as those shown in FIGS. 15, 16, 17, 18, and 21 through 27.

The direction and sequence of the attachment and detachment of the process cartridge 2105 or 2106 and the color developer cartridge 2004 can also be applied to the image forming apparatus using the belt type photoreceptor as shown in FIGS. 30 and 31 in the same manner as those in the foregoing examples.

Figure 19:
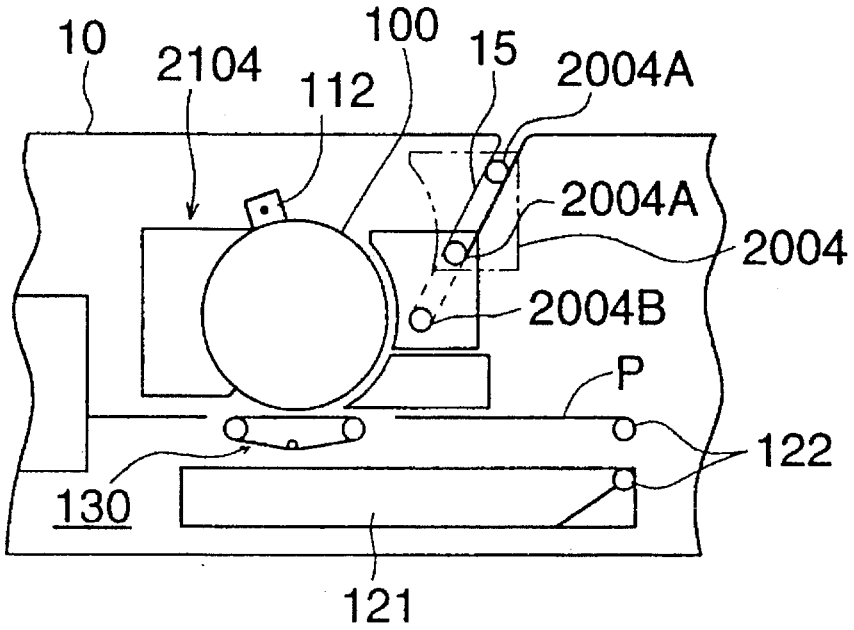
FIG. 19 is a partial side view of the color image forming apparatus in which a detaching guide for the color developer cartridge is incorporated.

Further, there is provided a color developer cartridge 2004 which is structured as follows. When two pins 2004A and 2004B provided on the cartridge 2004 are guided by a skewed slot 15 of the main body 10, the cartridge 2004 is separated from the photoreceptor drum surface and detached from the main body as shown by a side view in FIG. 19. This is preferable for preventing the photoreceptor drum surface from being damaged.

Figure 20:
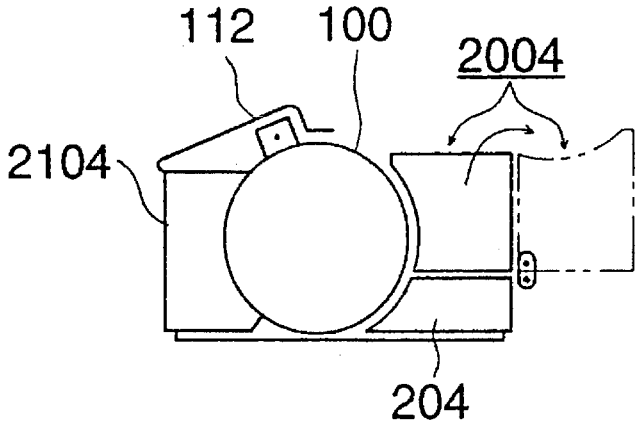
FIG. 20 is a side view expressing a combined condition of a process cartridge and the color developer cartridge.
Figure 21:
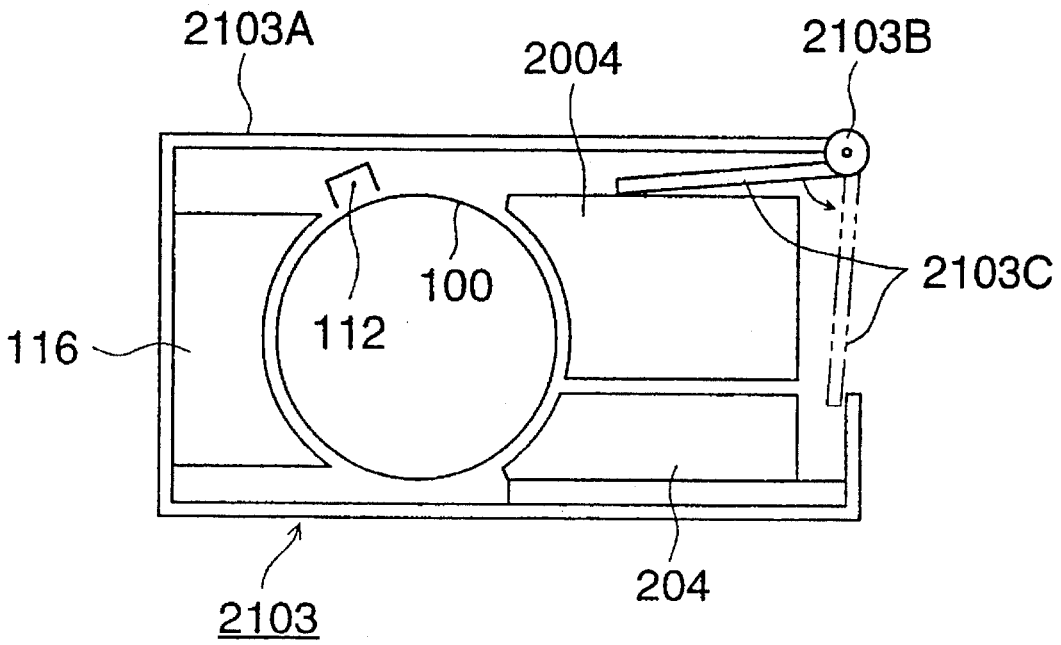
FIG. 21 is a side view of an example expressing the condition in which a shielding plate for photoreceptor light fatigue prevention is provided in the process cartridge.

In FIG. 20, the color developer cartridge 2004 is oscillated in the arrowed direction with respect to the process cartridge 2104, so that these cartridges do not interfere with each other. This is also a means to more positively prevent the photoreceptor surface from being damaged.

Figure 33:
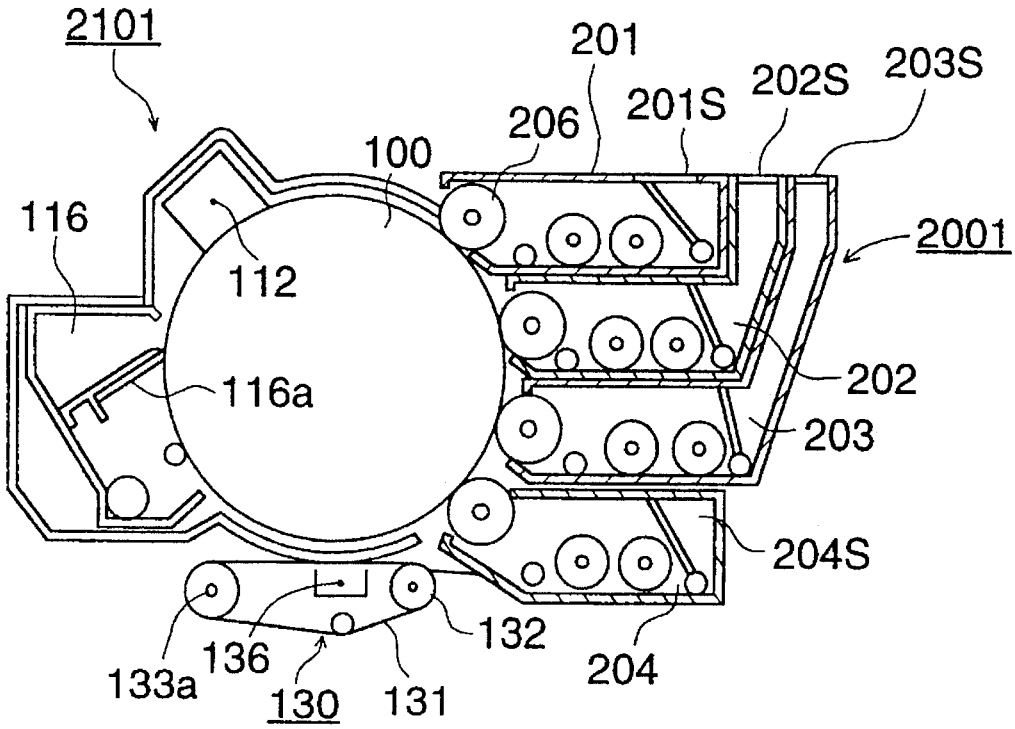
FIG. 33 is a side view of an example of the process cartridge and the color developer cartridge of the present invention.
Figure 34:
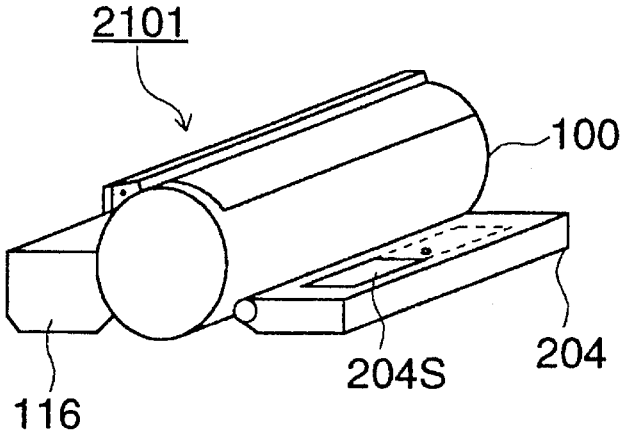
FIG. 34 is a perspective view of an example of the process cartridge of the present invention.
Figure 35:
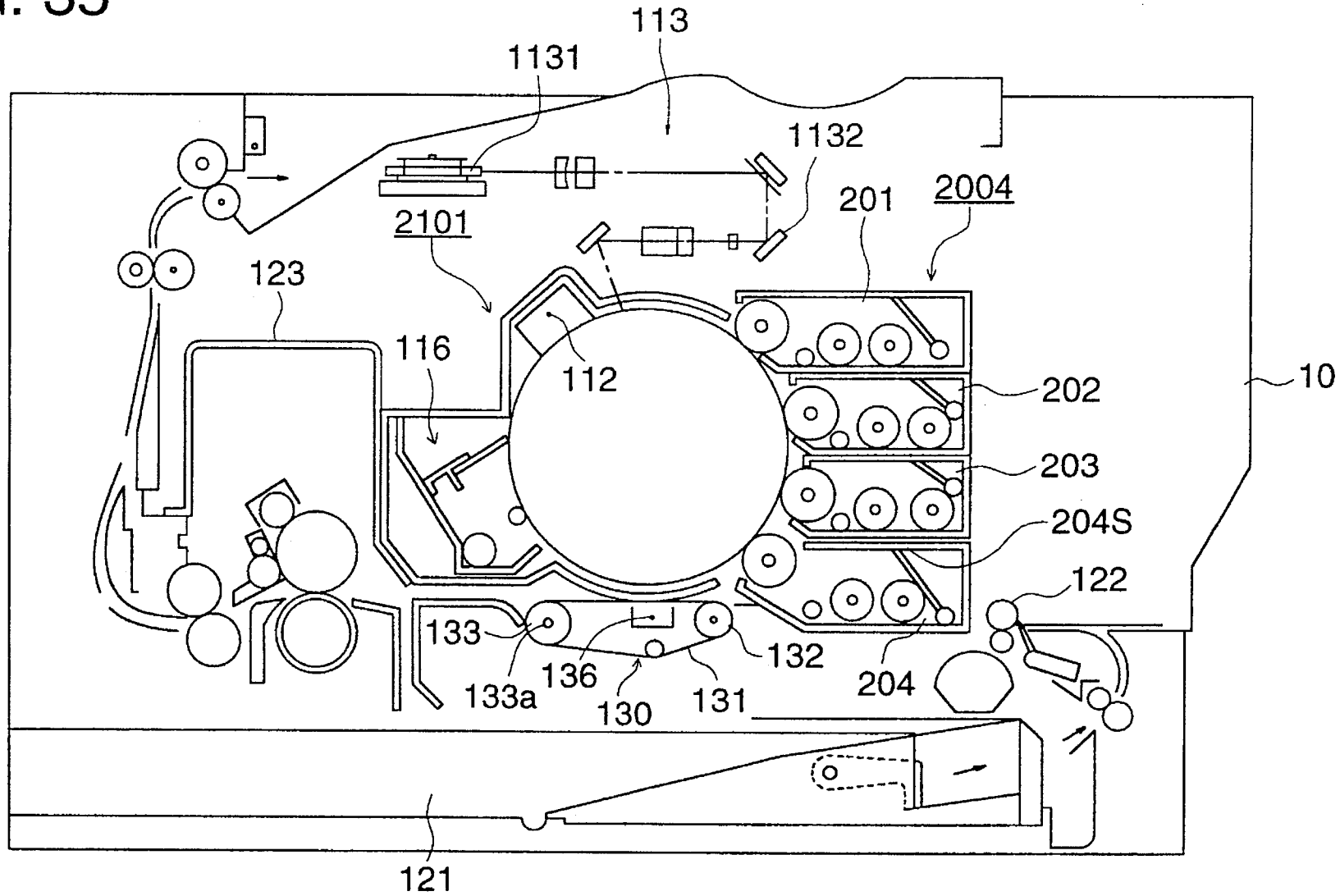
FIG. 35 is a side view of an example of the present invention.

The twenty sixth example of the present invention is structured as follows. In the color image forming apparatus having a general function for the foregoing color image formation, the process cartridge 2101 is formed as shown by a side view in FIG. 33 and a perspective view in FIG. 34 when the photoreceptor drum 100, cleaning unit 116, charger 112, and black developing unit 204 into which a black toner replenishing port 204S is incorporated are integrated with each other as shown by a side view in FIG. 35, the color developer cartridge 2004 into which Y, M, C color developing units 201, 202, 203 are incorporated, is formed as shown by a perspective view in FIG. 2 and these two cartridges can be separated from each other.

Figure 36:
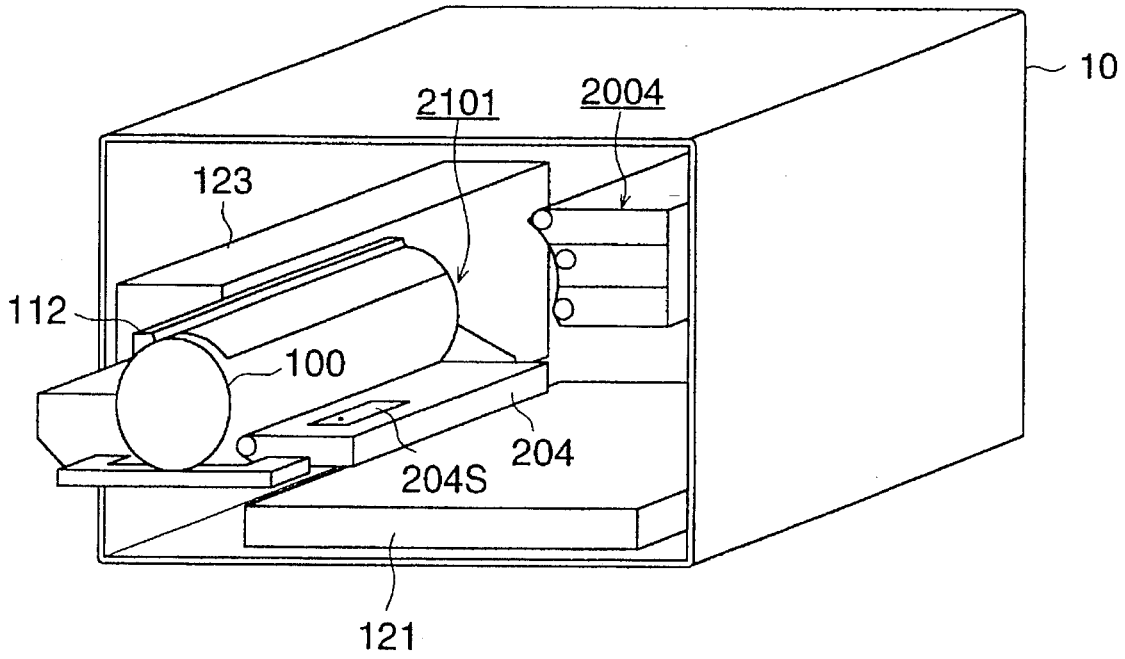
FIG. 36 is a perspective view of an example of the present invention.

In the twenty seventh example of the present invention, the separating operation is carried out as follows. The process cartridge 2101 is moved with respect to the color developer cartridge as shown by a perspective view in FIG. 36, and toner can be replenished from the toner replenishing port 204S of the black developing unit 204 under a condition in which the process cartridge is removed outside the apparatus.

Figure 37:
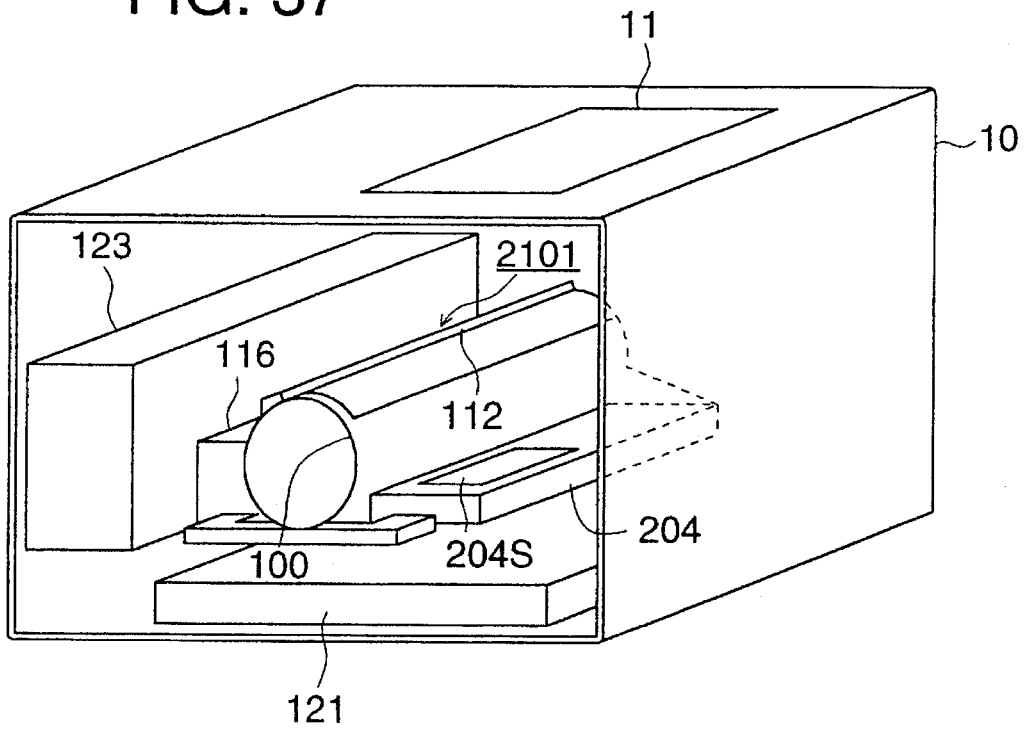
FIG. 37 is a perspective view of an example of the present invention.

Conversely, in the twenty eighth example, the process cartridge 2101 is fixed, and the color developer cartridge 2004 is moved with respect to the process cartridge 2101 and removed outside the apparatus as shown by a perspective view in FIG. 37.

Also, by the means described above, since the process cartridge 2101 and the color developer cartridge 2004 can be separated from each other, the following can be carried out. After the color developer cartridge has been removed from the image forming apparatus main body 10, a window at the ceiling portion of the main body 10 is opened as shown by the perspective view in FIG. 37 and the black toner can be easily replenished to the replenishing port 204S of the black toner hopper 204H.

Further, as shown by a perspective view in FIG. 2, the replacement system is structured as follows. The color developer cartridge 2004 is structured without providing the toner replenishing port on Y, M, C developing units 201, 202 and 203. When each toner is consumed, it is considered that the developing unit comes to the life, and then, the color developer cartridge is replaced.

Further, although the process cartridge 2101 includes the photoreceptor drum 100, charger 112, cleaning unit 116 and black developing unit 204, the process cartridge can also be structured without including the cleaning unit 116 and charger 112. In this case, the cleaning unit 116 and charger 112 are independently provided in the main body 10.

Three examples from the twenty sixth to the twenty eighth can also be applied to the clam-shell type photoreceptor drum type image forming apparatus as shown in FIGS. 28 and 29 in the same manner as described above. Further, these example can also be applied to the belt photoreceptor type image forming apparatus shown in FIGS. 30 and 31.

In the twenty ninth example of the present invention, in the side view of the image forming apparatus shown in FIG. 1, the photoreceptor drum 100, the black toner hopper 204H positioned above the cleansing unit 116 around the photoreceptor drum 100, and the black developing unit 204 provided below the color developer cartridge which is positioned at the opposite side of the cleaning unit 116, between which the photoreceptor drum 100 is sandwiched, are provided in the apparatus. The black toner hopper 204H is connected to the black developing unit 204 with, for example, a flexible screw pipe 204P shown by a dotted line in the drawing.

By the above-described structure, all the replenishing ports can be provided at the upper position. When the process cartridge is withdrawn or the optical system 113 is opened upward, toners can be replenished from the same direction, which is advantageous. This structure can also be applied commonly to examples from the thirtieth to the thirty second which will be described later.

Further, although the color developer cartridge 2004 into which Y, M and C developing units 201, 202 and 203 are integrated is provided in the apparatus, the color developer cartridge 2001 or 2003 in which the toner replenishing port is provided can also be structured.

In FIG. 1, although the color developer cartridge 2001 in which toner replenishing ports and toner hoppers are provided is attached to the apparatus instead of the color developer cartridge 2004, of course, the foregoing cartridge 2004 may be attached to the apparatus.

When the color image formation is not conducted, the apparatus can be used as a monochrome image forming apparatus under the condition that the color developer cartridge 2004, 2001 or 2003 is removed. Further, when the apparatus is used as a color image forming apparatus and the color developer cartridge has the life, the cartridge can be replaced with a new color developer cartridge 2004. When the color developer cartridge 2001 or 2003 is used, the color toner can be replenished to this type cartridge during operation.

In the thirtieth example of the present invention, the attachment and detachment of the color developer cartridge 2001 and removal of the process cartridge 2102 provided with a toner for black toner 204H are respectively conducted in the same direction as the shaft of the photoreceptor drum 100 so that these cartridges can be easily operated. When the apparatus is used for monochrome copying, of course, the color developer cartridge 2001 or 2004 may be taken out from the apparatus, or attached to the apparatus. Further, the color developer cartridge may be structured so that it can be detached in the perpendicular direction to the shaft of the photoreceptor drum 100.

As described above, the twenty ninth and the thirtieth examples can also be applied to the clam-shell type photoreceptor drum type image forming apparatus shown in FIGS. 28 and 29. Further, the examples can also be applied to the belt type photoreceptor image forming apparatus shown in FIGS. 30 and 31. In this case, the process cartridge is respectively structured as shown by numerals 2105 or 2106.

The thirty first example of the present invention is structured as follows. A black toner hopper 204H is provided adjoining the cleaning section as shown by the side view in FIG. 1; a black developing unit 204, to which the hopper 204H is connected with a screw pipe 204P, is provided in the apparatus; toner hoppers 201H, 202H and 203H are respectively assembled into each developing unit and thereby the color developer cartridge 2001 or 2003 is formed; the color developer cartridge is attached to the apparatus; and the black developing unit can be separated from the color developer cartridge.

By the means described above, although consumption of Y, M, C color toners and that of the black toner are different from each other depending on its use in the image forming apparatus, the effective toner replenishment depending on its frequency of use can be conducted, which is an advantage. Toners can be replenished at appropriate time from the upper portion of the main body under the condition that the cartridges are normally attached to the main body 10 or after the black developing unit and the color developer cartridge have been drawn out.

Figure 38:
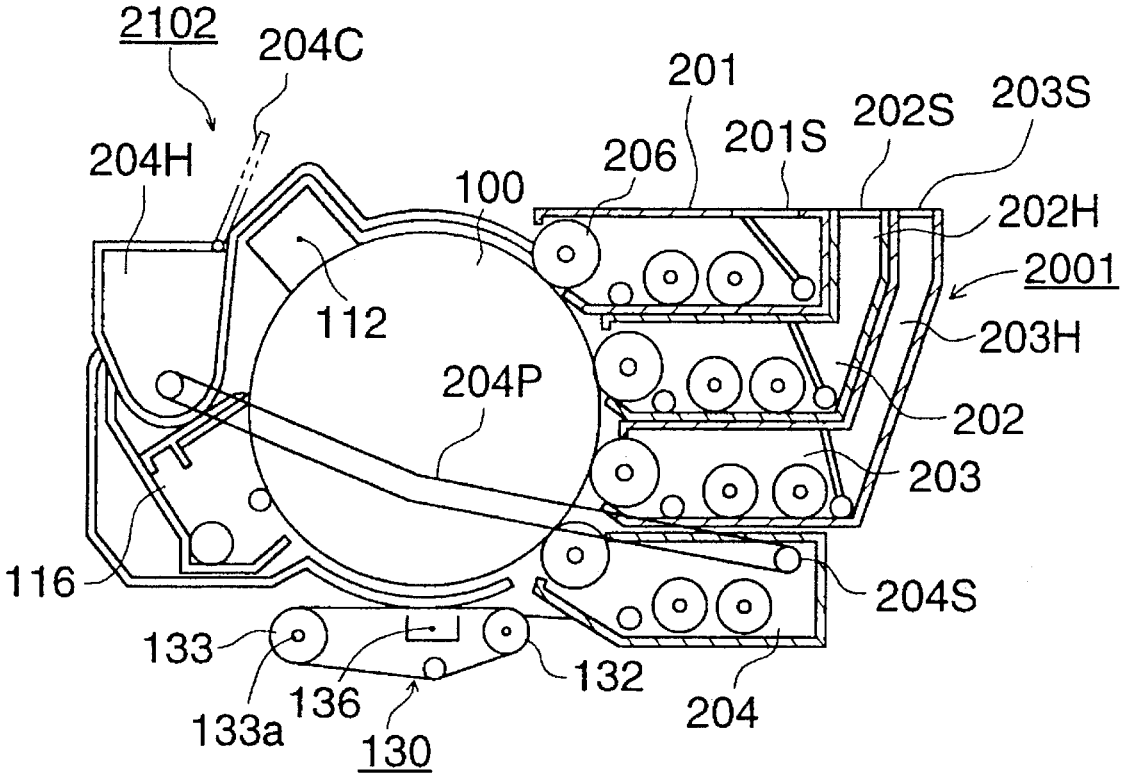
FIG. 38 is a side view of an example of the process cartridge and the color developer cartridge of the present invention.

The thirty second example of the present invention is structured as follows. As shown in FIG. 1, the black toner hopper 204H, the photoreceptor drum 100 as the image forming body and a black developing unit 204 are integrated with each other and formed into a process cartridge 2102 as shown by a side view in FIG. 38 in the thirty first example. The process cartridge can be separated from the color developer cartridge.

As described above, the thirty first and thirty second examples can be applied to the clam-shell type photoreceptor drum type image forming apparatus shown in FIGS. 28 and 29. Further, these examples can also be applied to the belt photoreceptor type image forming apparatus shown in FIGS. 30 and 31. In these cases, process cartridges are respectively structured as expressed by numeral 2105 and 2106.

The color image forming apparatus is structured as follows: a process cartridge includes an image forming body (photoreceptor), a black developing unit and its toner hopper as a base body, and further includes a peripheral units such as a charger, a cleaner, a discharger depending on the cases; Y, M, C color developing units are integrated with each other, and further toner hoppers for the developing units are combined to the developing units, and thereby a color developer cartridge is formed; the apparatus is formed into three blocks of the above-described two cartridges and ancillary units to the main body; and a block of the process cartridge and a block of the color developer cartridge can be attached to and detached from a block of the main body. When the color image forming apparatus is mainly used for monochrome image formation, the color developer cartridge is removed, and only when the apparatus is used for color image formation, the color developer cartridge can be attached to the apparatus for color image formation.

Accordingly, when the apparatus is used for monochrome image formation and there occurs a strong requirement for color image formation, the user can purchase only the color developer cartridge as an optional unit, and at this time, the apparatus can be changed to a color image forming apparatus.

Since Y, M and C developing units are integrated and formed into one cartridge, the color balance can be maintained until the cartridge completes its life span, or the time for replacement of toner comes. Accordingly, the toner can be effectively used, and the number of times for toner replacement or cartridge replacement can be reduced to the minimum.

When the black toner is frequently used, since the toner in the black cartridge is largely consumed, the requirement of replacement of the cartridge occurs. In this case, since Y, M and C toners are not so frequently used, and since the color developer cartridge is separated from the process cartridge and is formed into a unit, the color developer cartridge can be used for longer period of time than that of the process cartridge. Against the above-described means, in the conventional image forming apparatus in which the color developer units are integrated with the black developing unit, when the black developing unit completes its life span, the expensive color developing units which can still be used are abolished together with the black developing unit, which is a waste of money. This problem can be solved by the present invention.

By the above-described means, an effective method for using the apparatus, which is matched with conditions for each field of use, can be given to the color image forming apparatus. That is, under the conditions that an amount of use of the monochrome image is larger in the business field and that of the color image is larger in the graphic field, since the color image forming apparatus of the present invention is structured as described above, the color image forming apparatus of the present invention can easily comply with both requirements.

Further, interference of one cartridge with another cartridge can be easily prevented at the time of the attachment and detachment of two cartridges.

Further, toner hoppers can be integrated with cartridges, which is convenient.

Since a black cartridge can be attached to and detached from the apparatus even when a color developer cartridge composed of Y, M and C developing units is not perfectly attached to and detached from the apparatus, a replenishing operation for only a black toner can be more simplified.

A simple and secure mechanism can be applied for preventing the interference of the process cartridge with the color developer cartridge.

What is claimed is:

1. An image forming apparatus for reproducing an image on a recording sheet, comprising:

an image forming body having a rotation axis;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein:

said color developer cartridge means and said process cartridge means are arranged to be coupled with said image forming apparatus so that said process cartridge means is prevented from being detached from said image forming apparatus until after said color developer cartridge means is detached from said image forming apparatus;

said process cartridge means is detachable in a direction perpendicular to said rotation axis of said image forming body; and said color developer cartridge means is detachable in a direction perpendicular to said rotation axis of said image forming body; and said direction in which said process cartridge means is detachable is a direction opposite, in relation to said rotation axis of said image forming body, to said direction in which said color developer cartridge means is detachable.

2. An image forming apparatus for reproducing an image on a recording sheet, comprising:

an image forming body having a rotation axis;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein said process cartridge means is detachable in a direction parallel to said rotation axis of said image forming body; and said color developer cartridge means is detachable in a direction perpendicular to said rotation axis of said image forming body.

3. An image forming apparatus for reproducing an image on a recording sheet, comprising:

an image forming body having a rotation axis;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein said process cartridge means is detachable in a direction perpendicular to said rotation axis of said image forming body; and said color developer cartridge means is detachable in a direction parallel to said rotation axis of said image forming body.

4. An image forming apparatus for reproducing an image on a recording sheet, comprising:

an image forming body;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein said black developer means includes:

opening means, having an open condition and a closed condition, for receiving a toner when said opening means is in said open condition; and said opening means being in said open condition when said color developer cartridge means is detached from said image forming apparatus.

5. An image forming apparatus for reproducing an image on a recording sheet, comprising:

an image forming body;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus;

process cartridge means for unitedly supporting said image forming body, said black developer means, and said cleaning means; and said process cartridge means being detachable from said image forming apparatus; and a black color toner tank for storing said black color toner, and for supplying said black color toner to said black developer means, said black color toner tank including:

opening means, having an open condition and a closed condition, for receiving a toner when said opening means is in said open condition; and said opening means being changeable between said open condition and said closed condition when said color developer cartridge means is attached to said image forming apparatus.

6. The image forming apparatus of claim 5, wherein said black color toner tank is supported by said process cartridge means.

7. The image forming apparatus of claim 5, wherein said black color toner tank is located next to said cleaning means on a periphery of said image forming body.

8. The image forming apparatus of claim 5, wherein said process cartridge means includes:

shielding means, having a shielding position and an unshielding position, for preventing said image forming body from being exposed to a light when said shielding means is in said shielding position and as said color developer cartridge means is being detached from said image forming apparatus; and said shielding means enabling said process cartridge means to be accessible to said color developer cartridge means when said shielding means is in said unshielding position and said process cartridge means is attached to said image forming apparatus.

9. An image forming apparatus for reproducing an image on a recording sheet, comprising:

an image forming body;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein said yellow developer means, said magenta developer means, and said cyan developer means each includes an opening means, located on an upper portion of said color developer cartridge means, for receiving a toner.

10. The image forming apparatus of claim 9, wherein said process cartridge means includes:

shielding means, having a shielding position and an unshielding position, for preventing said image forming body from being exposed to a light when said shielding means is in said shielding position and as said color developer cartridge means is being detached from said image forming apparatus; and said shielding means enabling said process cartridge means to be accessible to said color developer cartridge means when said shielding means is in said unshielding position and said process cartridge means is attached to said image forming apparatus.

11. An image forming apparatus for reproducing an image on a recording sheet, comprising:

an image forming body;

latent image forming means for forming a latent image of said image on a surface of said image forming body;

black developer means for developing said latent image with a black color toner so as to form a black color developed latent image on said surface;

yellow developer means for developing said latent image with a yellow color toner so as to form a yellow color developed latent image on said surface;

magenta developer means for developing said latent image with a magenta color toner so as to form a magenta color developed latent image on said surface;

cyan developer means for developing said latent image with a cyan color toner so as to form a cyan color developed latent image on said surface;

transfer means for transferring at least one of said black color developed latent image, said yellow color developed latent image, said magenta color developed latent image, and said cyan color developed latent image from said surface to a recording sheet;

cleaning means for cleaning a residual toner on said surface after a transferring operation of said transfer means;

color developer cartridge means for unitedly supporting said yellow developer means, said magenta developer means, and said cyan developer means; and said color developer cartridge means being detachable from said image forming apparatus; and process cartridge means for unitedly supporting said image forming body, said black developer means, and said cleaning means; and said process cartridge means being detachable from said image forming apparatus; and wherein said process cartridge means is mounted in said image forming apparatus before said color developer cartridge means is mounted in said image forming apparatus.

* * * * *